US008123607B2

(12) United States Patent
Van Asdale

(10) Patent No.: US 8,123,607 B2
(45) Date of Patent: Feb. 28, 2012

(54) BINGO GAME

(75) Inventor: Shawn Michael Van Asdale, Reno, NV (US)

(73) Assignee: Shawn M. Van Asdale, Reno, NV (US)

( * ) Notice: Subject to any disclaimer, the term of this patent is extended or adjusted under 35 U.S.C. 154(b) by 1545 days.

(21) Appl. No.: 11/256,848

(22) Filed: Oct. 24, 2005

(65) Prior Publication Data

US 2006/0035700 A1 Feb. 16, 2006

Related U.S. Application Data

(63) Continuation-in-part of application No. 10/826,045, filed on Apr. 16, 2004, now abandoned.

(51) Int. Cl.
*A63F 3/06* (2006.01)

(52) U.S. Cl. ..... 463/19; 463/13; 463/16; 463/25

(58) Field of Classification Search ..... 463/19, 463/13, 16, 25

See application file for complete search history.

(56) References Cited

U.S. PATENT DOCUMENTS

| | | | | |
|---|---|---|---|---|
| 5,393,057 | A | 2/1995 | Marnell | |
| 5,482,289 | A * | 1/1996 | Weingardt | 273/269 |
| 5,882,260 | A | 3/1999 | Marks et al. | |
| 6,079,711 | A * | 6/2000 | Wei et al. | 273/269 |

(Continued)

OTHER PUBLICATIONS

Meisner, NIGC letter to Worldlink Gaming Corp., Aug. 1, 1997, 4 pages.

(Continued)

*Primary Examiner* — James S McClellan
*Assistant Examiner* — Lawrence Galka
(74) *Attorney, Agent, or Firm* — Lena T. Van Asdale

(57) ABSTRACT

A method and gaming device for wagering on and playing a bingo-type game is disclosed. More particularly, a method allows a player to use strategy to select or daub a number of bingo balls in a bingo-type game and forgo daubing other balls, thereby adding a new level of player interaction, and skill to the game of bingo while maintaining other features of a bingo game such as playing until at least one player wins the game.

5 Claims, 26 Drawing Sheets

U.S. PATENT DOCUMENTS

| | | | | |
|---|---|---|---|---|
| 6,203,429 | B1 * | 3/2001 | Demar et al. | 463/20 |
| 6,409,173 | B1 | 6/2002 | Tri | |
| 6,569,014 | B2 * | 5/2003 | Walker et al. | 463/13 |
| 6,581,935 | B1 * | 6/2003 | Odom | 273/269 |
| 6,656,044 | B1 | 12/2003 | Lewis | |
| 2002/0113369 | A1 * | 8/2002 | Weingardt | 273/269 |
| 2005/0096120 | A1 * | 5/2005 | Lind et al. | 463/19 |
| 2005/0221883 | A1 * | 10/2005 | Lind et al. | 463/19 |

OTHER PUBLICATIONS

Washburn, NIGC letter to Cadillac Jack, Inc., Mar. 27, 2001, 8 pages.
Coleman , NIGC letter to Multimedia Games, Inc., Sep. 23, 2003, 10 pages.
Coleman, NIGC letter to Sierra Design Group, Sep. 26, 2003, 18 pages.

* cited by examiner

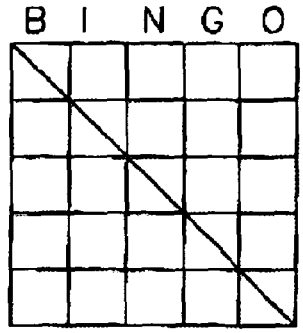
601
| | SPECIAL DAUB PAYS | REGULAR DAUB PAYS |
|---|---|---|
| ANY 5 DIAGONAL | 3 | 2 |
| ANY 5 HORIZONTAL | 5 | 3 |
| ANY 5 VERTICAL | 7 | 4 |
| KITE | 10 | 5 |
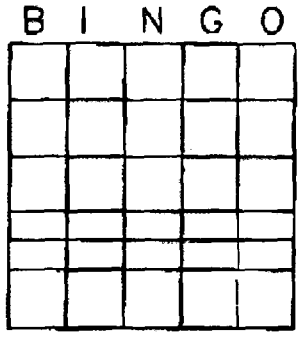
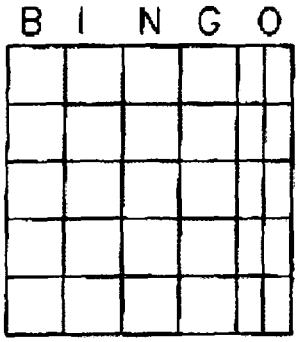
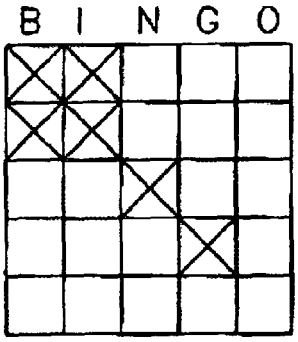
ALLOTTED DAUBS = 8
BALLS PER DRAW = 8
TOTAL NUMBER OF BALLS = 60
ONLY SINGLE HIGHEST PATTERN PAID
655
FIG-6

| 4 x 13 PATTERNS | STANDARD PAY IN ≤ 5 DAUBS | FIRST PAY PAY IN # OF DAUBS | RESULTING POKER HAND |
|---|---|---|---|
| LAST 5 SPOTS IN ONE ROW | 800 | 1/100 | ROYAL FLUSH |
| 5 CONSECUTIVE SPOTS IN ONE ROW | 50 | 1/100 | STRAIGHT FLUSH |
| 4 SPOTS IN ONE COLUMN | 25 | 1/100 | 4 OF A KIND |
| 3 SPOTS IN ONE COLUMN AND 2 SPOTS IN ANOTHER | 9 | 1/100 | FULL HOUSE |
| 5 SPOTS IN ONE ROW | 6 | 1/100 | FLUSH |
| 1 SPOT IN 5 CONSECUTIVE COLUMNS AND ANY ROWS | 5 | 1/100 | STRAIGHT |
| 3 SPOTS IN ANY 1 COLUMN | 3 | 1/100 | 3 OF A KIND |
| 2 SPOTS IN ANY 1 COLUMN AND 2 SPOTS IN ANY OTHER COLUMN | 2 | 1/100 | 2 PAIR |
| 2 SPOTS IN THE 10TH, 11TH, 12TH, OR 13TH COLUMNS | 1 | 1/100 | 1 PAIR |

ONLY HIGHEST STANDARD PAY PAID PER PLAYER
FIRST PAY IS AWARDED TO ONLY THE PLAYER
(OR PLAYERS IN THE EVENT OF A TIE)
WHO COMPLETES A PATTERN IN
THE FEWEST DRAWN BALLS

FIG-9

| 4 x 13 PAY PATTERNS FORMED USING FIRST 13 COLUMNS | STANDARD PAY IN < 6 DAUBS | POKER HAND DISPLAYED |
|---|---|---|
| LAST 5 SPOTS IN ONE ROW | 800 | ROYAL FLUSH |
| 5 CONSECUTIVE SPOTS IN ONE ROW | 50 | STRAIGHT FLUSH |
| 4 SPOTS IN 13TH COLUMN | 80 | 4 ACES |
| 4 SPOTS IN ONE COLUMN, IN 1ST, 2ND OR 3RD COLUMN | 40 | 4 OF A KIND – 2,3,4'S |
| 4 SPOTS IN ONE COLUMN | 25 | 4 OF A KIND 5'S TO K'S |
| 3 SPOTS IN ONE COLUMN AND 2 SPOTS IN ANOTHER COLUMN | 6 | FULL HOUSE |
| 5 SPOTS IN ONE ROW | 5 | FLUSH |
| 1 SPOT IN 5 CONSECUTIVE COLUMNS | 4 | STRAIGHT |
| 3 SPOTS IN ANY ONE COLUMN | 3 | 3 OF A KIND |
| 2 SPOTS IN ONE COLUMN AND 2 SPOTS IN ANOTHER COLUMN | 2 | 2 PAIR |
| 2 SPOTS IN ONE COLUMN, IN THE 10TH, 11TH, 12TH, OR 13TH COLUMN | 1 | PAIR OF JACKS OR BETTER |
| **4 X 4 PATTERNS FORMED USING LAST 4 COLUMNS** | **FIRST PAY IN ANY # OF DAUBS** | **POKER HAND DISPLAYED** |
| BLACKOUT – ALL SPOTS COVERED | 1/5 | NONE |

ONLY HIGHEST STANDARD PAY PAID PER PLAYER

EACH STANDARD PAY PATTERN MUST BE COMPLETED IN 5 OR FEWER DAUBS IN LEFTMOST 13 COLUMNS. IN THE EVENT NO PLAYER COMPLETES A STANDARD PAY PATTERN IN FIVE OR FEWER DAUBS, ADDITIONAL BALLS WILL BE DRAWN UNTIL THE FIRST PLAYER COVERS EACH SPOT IN THE "BLACKOUT" SECTION; THIS PLAYER WILL RECEIVE 1/5 OF A CREDIT TIMES THE AMOUNT WAGERED

FIG–14

| 4 x 13 PAY PATTERNS FORMED USING TOP 4 ROWS | STANDARD PAY IN < 6 DAUBS | POKER HAND DISPLAYED |
|---|---|---|
| LAST 5 SPOTS IN ONE ROW | 800 | ROYAL FLUSH |
| 5 CONSECUTIVE SPOTS IN ONE ROW | 50 | STRAIGHT FLUSH |
| 4 SPOTS IN 13TH COLUMN | 160 | 4 ACES |
| 4 SPOTS IN ONE COLUMN, IN 1ST, 2ND OR 3RD COLUMN | 80 | 4 OF A KIND – 2,3,4'S |
| 4 SPOTS IN ONE COLUMN | 50 | 4 OF A KIND 5'S TO K'S |
| 3 SPOTS IN ONE COLUMN AND 2 SPOTS IN ANOTHER COLUMN | 9 | FULL HOUSE |
| 5 SPOTS IN ONE ROW | 6 | FLUSH |
| 1 SPOT IN EACH OF 5 CONSECUTIVE COLUMNS | 4 | STRAIGHT |
| 3 SPOTS IN ANY ONE COLUMN | 3 | 3 OF A KIND |
| 2 SPOTS IN ONE COLUMN AND 2 SPOTS IN ANOTHER COLUMN | 1 | 2 PAIR |
| 2 SPOTS IN ONE COLUMN, IN THE 10TH, 11TH, 12TH, OR 13TH COLUMN | 1 | PAIR OF JACKS OR BETTER |

| NUMBER OF SPOTS COVERED IN 5TH ROW DURING FIRST BALL DRAW | PAY MULTIPLIER |
|---|---|
| 0 TO 4 SPOTS | 1 |
| 5 TO 6 SPOTS | 2 |
| 7 TO 9 SPOTS | 5 |
| 10 TO 13 SPOTS | 10 |

FIRST AND SECOND BALL DRAW WILL CONTINUE UNTIL 5 BALLS BETWEEN 1 AND 52 ARE DRAWN

ONLY HIGHEST STANDARD PAY TIMES THE 5TH ROW MULTIPLIER PAID PER PLAYER

EACH STANDARD PAY PATTERN MUST BE COMPLETED IN 5 OR FEWER DAUBS IN TOP 4 ROWS

IN THE EVENT NO PLAYER COMPLETES A STANDARD PAY PATTERN IN FIVE OR FEWER DAUBS, ADDITIONAL BALLS WILL BE DRAWN UNTIL THE FIRST PLAYER COVERS EACH SPOT IN THE 5TH ROW; THIS PLAYER WILL RECEIVE 1/5 OF A CREDIT TIMES THE AMOUNT WAGERED

FIG–17

990
991
992
SPADES
HEARTS
DIAMONDS
CLUBS
MULTIPLIER
2 3 4 5 6 7 8 9 10 J Q K A
37 6 43 52 35 39 19 7 3 32 46 30 12
42 51 15 36 1 13 49 9 45 50 29 47 22
5 26 17 10 20 24 4 23 40 8 41 34 31
27 11 28 44 16 38 18 25 14 48 33 2 21
75 64 67 53 73 56 71 74 66 60 59 54 58
7 43 50 57 18
75 50 67 66
54 60 31
974
975
976
994
2X
18
31
DAUB
50
DAUB
43
7
980
981
981A
980A 2 3 4 5 6 7 8 9 10 J Q K A
SPADES 37 6 43 52 35 39 19 7 3 32 46 30 12
HEARTS 42 51 15 36 1 13 49 9 45 50 29 47 22
DIAMONDS 5 26 17 10 20 24 4 23 40 8 41 34 31
CLUBS 27 11 28 44 16 38 18 25 14 48 33 2 21
MULTIPLIER 75 64 67 53 73 56 71 74 66 60 59 54 58
75 43 54
50 60
67 57 31
66 18 32
12 68 38
995
32
996
12
997
38
DAUB
50
DAUB
31
2X
995A
996A
997A

BINGO GAME

CROSS-REFERENCE TO RELATED APPLICATION

This is a continuation-in-part of U.S. patent application Ser. No. 10/826,045, filed Apr. 16, 2004 now abandoned in the name of Shawn M. Van Asdale, to which priority is claimed.

TECHNICAL FIELD OF THE INVENTION

This invention relates to a method of playing a bingo-type wagering game. More particularly, the invention relates to a method for allowing a player to use strategy to select or daub a number of bingo balls in a bingo-type game and forgo daubing other balls, thereby adding a new level of player interaction, and skill to the game of bingo while maintaining other essential elements of a bingo game.

BACKGROUND OF THE INVENTION

Bingo is one of the most prevalent forms of gaming across the United States. In the United States it is organized by, among others, charity groups and Native American tribes that operate casinos or gambling parlors. Bingo may be played using electronic devices or in its non-electronic form which has existed for several years. In the typical non-electronic form each player purchases at least one bingo card (but often more than one card) that is good for a specified ball draw or bingo session, e.g., the nine o'clock session. Each session typically has a plurality of bingo games and each bingo game comprises a drawing of bingo balls. Each drawing uses a predetermined number of bingo balls, typically seventy-five. The typical bingo card is a 5×5 matrix where each column is identified by a letter, B-I-N-G-O, and at each coordinate or space in the matrix a number is provided. Typically, the "B" column contains numbers ranging from one to fifteen, the "I" column contains numbers ranging from sixteen to thirty and so on. As balls are drawn, the number of the ball is called out and the players determine if their card(s) has the drawn ball. If a player's card(s) has the drawn ball, the player will daub the spot on his card(s) corresponding to the drawn ball. Daubing is often accomplished in the non-electronic game by the use of a special ink marker, but players may use other means to record the selection of a ball on their card(s), including placing an object such as a coin or bean on the spot.

In each bingo game there are one or more patterns that, when completed, will entitle the player who completed one or more of the designated patterns to a prize and that may or may not end the bingo game. A wide variety of patterns have been used in these games. A "simple" pattern may be any horizontal line of five daubed spots. However, there is virtually no limit to the number or complexity of patterns that may be used. For instance, the pattern could be a "kite" which is defined as a four daubs in a square pattern with two daubs in a diagonal line and diagonally touching a point of the square to form the "kite's tail." Thus, the players of the bingo game are competing with each other to complete one or more of the designated patterns. Often, only the first player to complete each pattern is awarded the prize associated with the pattern. In addition to varying the pattern that is used, bingo games may vary the size of the matrix used or the number of bingo balls that are used to provide additional variety and excitement to the game.

Electronic bingo games operate in much the same way as non-electronic games with a few differences. The most notable difference between electronic bingo and non-electronic bingo is that the electronic bingo balls are drawn much faster and microprocessors are used to determine if a player's bingo card contains a spot that matches a drawn ball. As a result, the players do not daub balls individually. Rather, the player's electronic device or gaming terminal that is being used to play bingo will automatically daub multiple balls for the player at the touch of a button. Thus, it is no longer up to the player to watch the ball draw and determine if any of the balls drawn appear on the player's bingo card. With this electronic setup, all balls drawn that appear on a player's card are either instantly daubed as soon as the ball is drawn or a player may periodically hit a daub button to update multiple balls on his card at once. The ability to draw balls quicker and to almost instantaneously automatically daub spots that match the drawn balls allows players of electronic bingo to play many more bingo games in a given amount of time than they could playing non-electronic bingo. Also, because a computer or other electronic device is used to monitor the bingo game, far more complex bingo patterns can be used than in non-electronic bingo games.

These differences between electronic bingo and non-electronic bingo have led to electronic bingo terminals that display, in addition to a bingo card, other entertaining graphics to the player. The most successful such devices display what appears to be a slot machine like those used in Las Vegas to display a winning outcome during the play of a bingo game. These bingo terminals often determine the amount of a player's win for a winning outcome, if any, based on one or more of the following criteria: the number of players playing the game, the number of balls it took the player to complete a pattern and the specific pattern completed. Once the amount of the win is determined, the portion of the terminal resembling a slot machine is then used to display a combination of slot machine symbols that would correspond to the determined amount. Thus, the basic game being played is a multi-player bingo game that includes a slot machine display of winning outcomes, giving each player the perception that he is playing a slot machine.

In the non-electronic form of bingo described above, the player uses a certain amount of skill to recognize that his bingo card or cards contain a spot matching a drawn ball and to daub the spots corresponding to that ball in the time before the next ball is drawn, although there is typically no time limit placed on how quickly a spot must be daubed. Because there is no additional cost associated with daubing a spot and because there is no penalty involved with daubing a spot that is subsequently not used to complete a bingo pattern, the player will, if he is able, daub every possible spot that he can. Thus the amount of player interaction in non-electronic bingo is very limited. In electronic bingo, a computer determines whether a player's card has a spot that matches or concords with any drawn balls. And for the same reasons as those discussed in non-electronic bingo, there has never been a need in the electronic form of bingo described above to allow a player to daub some spots but not others. As a result, the level of player interaction in electronic bingo is even less than in non-electronic bingo and the level of competition between players is also reduced.

SUMMARY OF THE INVENTION

It is an object of the present invention to provide a method for playing a wager-based bingo-type game which overcomes the above-described shortcomings associated with the known forms of both electronic and non-electronic bingo games and yet maintains the essential aspects of a bingo game as may be required by various jurisdictions, by presenting the player with a strategic decision for at least a portion of the bingo balls that are drawn and that may be daubed on the player's bingo card. It is still a further object of the present invention to provide visual indicia familiar to a large number of gaming patrons that will quickly and easily convey the strategic decisions available to the players of the bingo game.

Strategic decision or strategy as used herein is accorded its usual meaning in the gaming art and relates to decisions that can be made based on statistical probability and expected value to maximize a player's chance of success, even if the player is not completely aware of, or even misunderstands, the mathematical principles involved. In this context, strategic decision also refers to the decision by a player whether or not to daub a spot on his card when a corresponding ball is drawn based on any number of factors including the pays associated with various bingo patterns, the other balls that have been drawn, the number of balls remaining, etc. Penalty as used herein is also accorded its usual meaning in the gaming art, and more specifically, in the context of the present invention, means a player using or not using one daub on a spot that reduces the probability of a player completing at least one specific paying bingo pattern either because for instance, other balls required for any winning pattern were already, or will be disregarded (i.e., undaubed), or there are fewer daubs remaining to complete another more desirable pattern or the pattern involving the penalty daub is less desirable than another pattern. In this context, those skilled in the art will understand that a strategic decision that is mathematically correct or optimal may involve not daubing a spot that is likely to result in a bingo win (or may even complete a winning bingo pattern at the very time the decision is made not to daub it) because the probabilities and payouts involved dictate that the player tries for a higher paying pattern. In this case, the failure to daub the spot is still a penalty, even though it was mathematically optimal (i.e., strategically correct) to incur the penalty.

The method of the present invention involves determining a first number of daubs to be used by a player and a first number of bingo balls to be drawn. The first number of daubs allotted to the player is preferably less than or equal to the first number of bingo balls to be drawn. Preferably the first number of daubs allotted and the first number of bingo balls drawn are determined well in advance of the players initiating the bingo game and remain constant from game to game. After the first number of balls is drawn, the players chose which if any of their first number of allotted daubs they will use to selectively daub spots matching the balls drawn. This determination should be made by each player in order to maximize each particular player's chances of success. After each player has made his daub selections, additional bingo balls may or may not be drawn. The drawing of additional balls may depend on whether a player achieved a game-ending bingo pattern during the first selection. The spots matching the additional balls drawn after the first selection may be daubed automatically according to the number of remaining first allotted daubs that each player has after the first selection or these spots may again be selectively daubed by each player. At some point in the game, it may be desirable to rapidly provide bingo balls to the player that can be daubed without penalty. This may be done, for instance, to ensure that at least one player completes a game-ending bingo pattern when all players have used their number of first allotted daubs and no player has completed a game-ending bingo pattern within the allotment.

It will also be preferable to offer a large variety of bingo patterns for the players to attempt. It will also be desirable for the prizes associated with the patterns to vary. Preferably the prize amounts will relate to the statistical probability of successfully completing the bingo pattern either in a certain number of drawn bingo balls, a certain number of daubs or before other players complete a game-ending bingo pattern.

Although the method of the present invention may be practiced in a non-electronic format, it will be appreciated by those skilled in the art that an electronic format will both facilitate the ease of play as well as dissuade and/or prevent players from attempting to cheat the game by altering their daub selections after additional balls are drawn. Also, although the present invention may be enjoyably played by a single player competing against only a computer opponent and/or a pay table when making his strategic decisions with respect to which balls to daub, it is most preferred that players compete against each other in at least a portion of the game.

In its electronic format, the bingo game according to the present invention can associate traditional playing cards in a visual presentation that resembles poker. Preferably the poker game being imitated will be one of the many popular five-card video draw poker games played in Las Vegas style casinos on stand-alone slot machines. In such an embodiment the traditional 5×5 bingo matrix may be changed to a 4×13 matrix to represent a standard deck of fifty-two playing cards. (It should be understood that for the purposes of this invention, there is no difference between a 4×13 matrix with four horizontal rows and a "13×4" matrix with four vertical columns.) A larger matrix that includes a 4×13 portion may also be used. For instance, in one preferred embodiment, the matrix is a 5×13 matrix. Regardless of the total size of the matrix, each of the four rows of the 4×13 portion of the matrix is preferably associated with one of the four suits used in poker—clubs, diamonds, hearts and spades. And thirteen of the columns in the matrix are associated with a card ranking of Two through Ace. (It would also be possible to represent a 52-card playing deck with a 4×14 matrix. In a matrix with a 4×14 portion devoted to playing cards, the Ace may appear in both a first column and a fourteenth column. The general desirability of using a 4×14 matrix to allow for both a "high" and a "low" Ace to complete both an Ace-high straight and a Five-high straight will be appreciated by those familiar with poker, and further reference herein to a poker-type bingo game using the present invention will make reference to a 4×13 matrix, or a 4×13 portion of a larger matrix generally, with the understanding that a 4×14 matrix or matrix portion could also be used with little alteration of the underlying game. Alternatively, the problem of the "low" Ace used in a straight could be addressed by defining an additional bingo pattern of one spot in each column of the first four columns and one spot in the last column.) Thus, each position of the 4×13 portion of the matrix may be associated with exactly one card from a 52-card playing deck.

In the 5×13 embodiment, the top four rows of the matrix may be identical to the 4×13 matrix from the previous embodiment and the fifth row may have additional uses. Also, although a standard 52-card playing deck is preferred, the game could be adapted to a larger or smaller playing deck as desired. For instance, if a poker game or other card game is desired to be simulated that uses a deck of cards having three suits (i.e., Hearts, Clubs and Spades) with card rankings of Eight through Ace a 3×7 matrix may be employed.

On each player's bingo card matrix preferably only one number will be randomly assigned to the spots on the player's bingo card from the population that makes up the numbers appearing on the bingo balls available to be drawn in the bingo game. When a 4×13 matrix is used, it may be desirable to use fifty-two bingo balls rather than seventy-five and to randomly assign a number from one to fifty-two to each spot in the matrix. Thus, for every player, any ball drawn will result in the opportunity to daub exactly one spot on his bingo card and will be associated with exactly one playing card.

When a matrix larger than 4×13 is used, the number of bingo balls will preferably be at least as great as the number of spots on the matrix and preferably will be greater. However, it may still be desirable to randomly distribute the same range of numbers in the 4×13 portion of the bingo card for each player. For instance, when a 5×13 matrix is employed and the number of bingo balls is seventy-five, in one preferred embodiment, the 4×13 portion of the matrix on each player's bingo card will have the numbers one to fifty-two randomly arranged thereon, while the fifth row of the matrix will have thirteen numbers from the remaining range of fifty-three to seventy-five randomly arranged thereon. (Of course, the exact range used may be arbitrary, as it is typically the population of balls within the range that is important. So in the preceding example, the fifth row could contain thirteen numbers from the range of one to twenty-three and the 4×13 portion could contain numbers twenty-four to seventy-five). By randomly distributing the same range of numbers in each player's 4×13 portion of the bingo card, it is assured that when a bingo ball from that range is drawn, each player will have exactly one matching spot on his 4×13 portion and the spot will be associated with exactly one playing card.

In the versions of the present invention that emulate five-card video draw poker, the bingo patterns used will correspond to traditional hand rankings of poker and the payout for each pattern will approximately correspond with the payouts associated with traditional video poker. Thus, any horizontal line of five daubs on the 4×13 portion of the bingo card would preferably result in a payout of approximately fifty credits for each credit bet and would provide the player with a visual indication of five cards of the same suit all in numerical succession, i.e., a straight flush.

In the versions where the bingo card is a 4×13 matrix and the number of bingo balls is fifty-two, each player would preferably be initially allotted five daubs and the initial draw of bingo balls will also preferably be five. After the five bingo balls are drawn, the player's terminal would preferably show the player the five balls and the corresponding spots on the player's card as well as the playing cards associated with each spot. The player would then be given the opportunity to selectively daub none, one, two, three, four or all of the spots on his card based on the initial draw. For each spot that is daubed, the corresponding card would also be "held." After the player has determined which of the five spots he wishes to daub, he would hit a button signaling his desire to proceed with the drawing of additional bingo balls. After all the players enrolled in the bingo game have indicated their desire to draw the additional balls, the second draw will begin. As each ball is drawn in the second draw, each spot on each player's card corresponding to the drawn ball is automatically daubed until all of the player's remaining allotted daubs that were not used on the first round of drawn balls are used up. Thus, in this preferred embodiment, the second ball draw will never exceed five balls (the maximum number of remaining daubs being five if a player chose not to daub any spots during the first round).

In other versions of the present invention designed to emulate the play of a game of video poker, but utilizing either a matrix greater than 4×13 and/or a number of bingo balls greater than fifty-two, it may be desirable to alter the foregoing parameters for the initial draw. Although it would still be possible to limit the number of allotted daubs and balls drawn to a predetermined number, this may result in players having varying numbers of spots available for daubing at the conclusion of the first draw, and thus may also result in some players having more playing cards than other players in the same draw. Those familiar with the art of video poker and gaming in general will appreciate that it may be desirable to avoid the foregoing situations.

Therefore, the first draw may be chosen only from the range of balls in the 4×13 portion, where each player's bingo card contains the same fifty-two balls randomly distributed in the 4×13 portion of the matrix, with each bingo card having a different random distribution. In this manner, the first ball draw may again be limited to a predetermined number of balls (e.g., five). The second ball draw could be handled in a similar fashion by again limiting the draw to a subset of the total bingo balls (e.g., balls numbered one to fifty-two). Spots matching balls from the second ball draw could be automatically daubed as before until the player's allotment of daubs is used up. After the second ball draw, additional balls could be drawn either from the entire set of bingo balls or from the subset of bingo balls that, to this point, has been excluded. The third ball draw may be used for a variety of ancillary uses, including, but not limited to, determining a game-ending pattern if none was formed in the first two ball draws, determining a multiplier that will be applied to a player's win or determining a bonus award for one or more players. Alternatively, these ancillary uses could be determined in a first ball draw where the subset of bingo balls drawn is limited to those numbers randomly arranged outside of the 4×13 portion of the matrix. As a result of this ball draw, preferably none of a player's allotment of daubs would be used.

As an alternative, it is possible to draw from the entire set of bingo balls until the desired number of matches in the 4×13 portion of the matrix has occurred (e.g., five matches). Thus, the first or second ball draw may be a variable number of balls, but the number of matches in the 4×13 portion of the matrix will be consistent from game to game while the number of matches occurring outside of the 4×13 portion of the matrix may vary from game to game and from one player's card to another player's card within a single game in either the first or second ball draw. In this embodiment, it may be desirable to allow a player to daub spots outside of the 4×13 portion of the matrix without penalty and/or without reducing the player's allotment of daubs. And if no penalty is involved, it may also be desirable to have these spots daubed automatically.

In each of these versions of the invention, after at least the second round of ball draws is completed and after each player has used his allotment of daubs, either through automatic or selective daubing, each player's card is examined to determine if that player completed a winning bingo pattern using only the initial allotment of daubs (e.g., five). For the purposes of this evaluation, spots that were not daubed either because the player chose not to daub them during the initial round or because the player had already used up his allotment of daubs in or prior to the second round are ignored. For each player that completed a winning pattern using five or fewer daubs, a prize according to the predetermined prize table will be paid to the player. This may also constitute a game-ending bingo pattern that will end the game. If no player completed a winning pattern using five or fewer daubs, the undaubed spots corresponding to previously drawn balls may also be reviewed or other balls may be drawn that will automatically be daubed using a second unlimited allotment of daubs until a predetermined game-ending bingo pattern occurs. These patterns may include, but are not limited to, the patterns for which payouts are provided for the initial five daubs or fewer and will preferably payout much less than the patterns accomplished using the initial five daubs.

In an alternative form of the invention, each player has available to him two types of daubs. The first type of daub operates like standard bingo daubs, i.e., there is no penalty for daubing a spot and there is no strategic decision to be made when a player's bingo card contains a spot corresponding to a drawn ball. The second type of daub is either limited in number or is used to complete bingo patterns that have a payout dictated in part by the number of daubs used to complete the pattern. The player can choose whether or not to use the second type of daub when a spot on the player's bingo card corresponds to a drawn ball. Thus, this decision involves a strategic risk-reward decision and the possibility of a penalty.

These and other objects, advantages, and features of the invention will be apparent from the following description of the preferred embodiments, considered along with the accompanying drawings.

BRIEF DESCRIPTION OF THE DRAWINGS

FIG. 6 shows a pay table that may be used in the present invention.

FIG. 9 shows an alternative pay table that may be used in the present invention and shows how bingo patterns may be associated with traditional poker hand rankings.

FIG. 14 shows an alternative pay table that may be used in the present invention.

FIG. 17 shows an alternative pay table that may be used in the present invention.

DETAILED DESCRIPTION OF THE PREFERRED EMBODIMENTS

Figure 1:
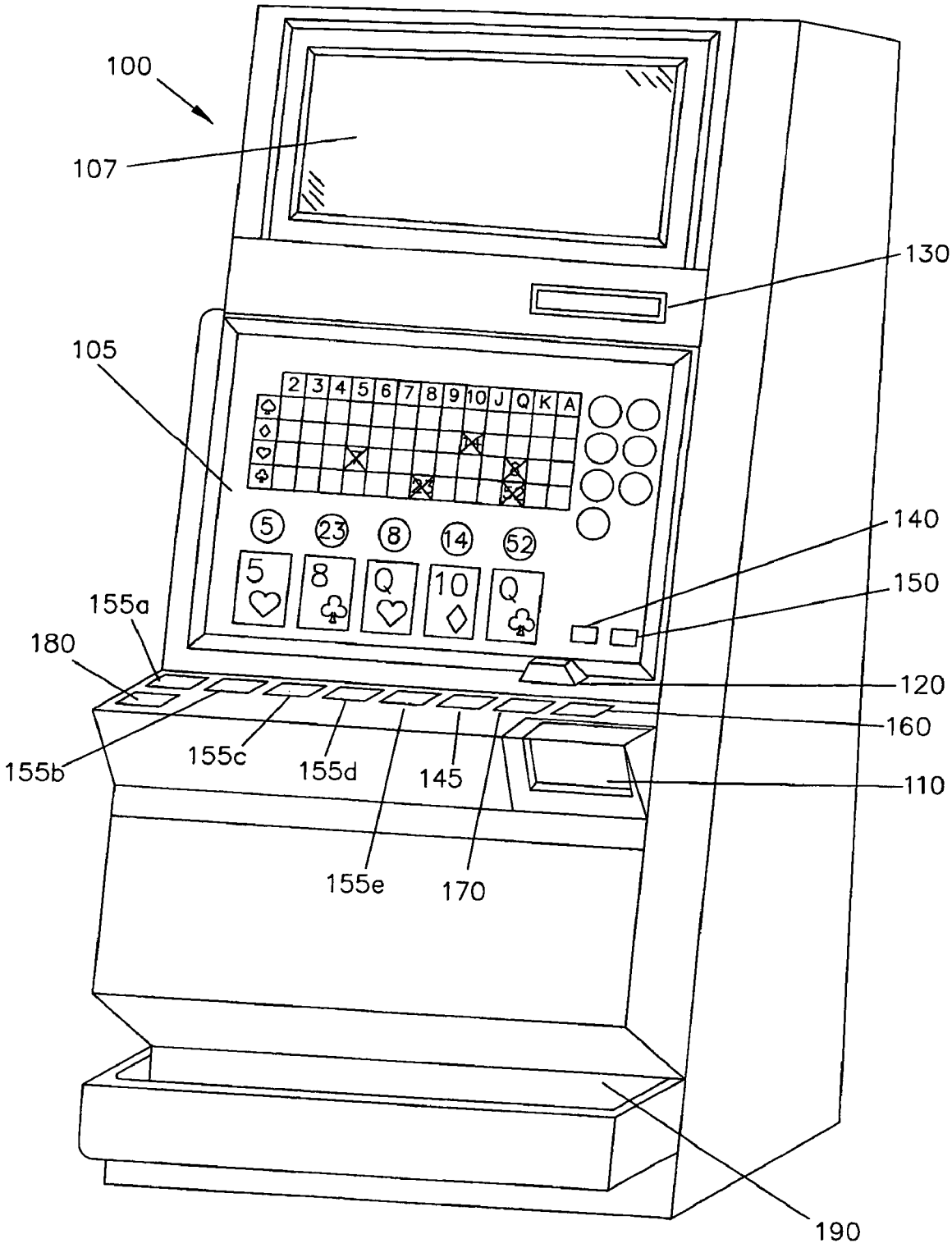
FIG. 1 shows an electronic gaming terminal for playing a bingo game according to the method of the present invention.

FIG. 1 shows a player terminal or gaming device 100 for implementing the present invention. Gaming device 100 has the features of a conventional player terminal or slot machine. The gaming device 100 shown in FIG. 1 is what is commonly referred to as an electronic bingo terminal. FIG. 1 displays a bingo terminal that is very similar to an upright slot machine which the player can operate while standing or sitting. Most often the gaming device 100 is preferably mounted on a cabinet. (Not shown.) Although an upright electronic bingo terminal 100 is shown in FIG. 1, it can be appreciated that the gaming device 100 can be any other style of gaming machine known in the art including, but not limited to, a pub-style tabletop or slant-top game in which a player can operate while sitting. The gaming device 100 can be constructed with varying cabinet and display designs.

Gaming device 100 may also include one or more display devices. The embodiment shown in FIG. 1 shows a central display 105 and an upper display 107. The upper display 107 may be used to show an electronic bingo game or a bonus game, while the central display 105 may display an electronic bingo game and/or ancillary visual indicia representing such games as slots, video poker, blackjack and/or keno. More specifically, the visual indicia could include, but is not limited to, playing cards and/or slot machine reels with symbols. The symbols and indicia used on and in gaming device 100 may be in mechanical, electrical, electronic or video form. The central display 105 in FIG. 1 shows both an electronic bingo game and visual indicia of playing cards.

It should be appreciated that the display devices may display any visual representation or exhibition including, but not limited to, video images or movement of physical objects such as mechanical reels and wheels. The display devices can be a video monitor or screen, a liquid crystal display or any other display mechanism. Furthermore, it should be appreciated that these display devices preferably include touch screen displays.

As shown in FIG. 1, gaming device 100 includes a wager accepting mechanism 110. The wager accepting mechanism 110 can be a bill acceptor. The wager accepting mechanism 110 can also accept other forms of payment including, but not limited to, tickets, smart cards, debit cards and credit cards. With these other types of payment, other types of validators or readers other than a bill acceptor may be used. There is also a coin slot 120 on the gaming device 100 into which a player can insert coins or tokens.

Often, there is also a card reader 130. The card reader 130 may include any type of card reading device, such as a magnetic card reader or an optical card reader. The player will insert a card, such as a player tracking card or a credit card, into the card reader 130 which will then read data from the card. The card reader 130 may be used to read and/or write from and/or to the inserted card.

After a player inserts money in the gaming device 100, either via the coin slot 120 or the wager accepting mechanism 110, a number of credits corresponding to the amount deposited is shown in a credit meter 140. After money is credited to the machine 100 and shown on the credit meter 140, the player then determines the wager amount. In order to facilitate the wager, the player may alternatively push a bet one credit button 170 repeatedly until the number of desired credits to be wagered is reached or may push a maximum bet button 150 which automatically allows the player to wager the maximum amount on the gaming device 100. As the player is selecting the wager amount, this wager amount is displayed on a bet display 160. As the bet display 160 amount is incrementing, the credit meter 140 amount is decrementing by the corresponding amount. In should be appreciated by anyone of known skill in the art that a player may also interact with the gaming device 100 by touching the appropriate marked regions on the displays 105 and 107 when the displays are equipped with touch screens. Once the player has finalized his wager amount, the player may initiate play either by pressing a "Play" button or a "Draw/Continue Draw" button 145 or by touching the appropriate region on the displays 105 and 107.

To accomplish the selective daubing of the present invention, a number of daub buttons 155*a*, 155*b*, 155*c*, 155*d*, and 155*e* may be provided on the gaming device 100. Each daub button 155*a*, 155*b*, 155*c*, 155*d*, and 155*e* preferably corresponds to exactly one spot or exactly one corresponding bingo ball drawn. Alternatively the player may select which spots to daub using the touch screen to either touch the spot or the corresponding ball. When the daub buttons 155*a*, 155*b*, 155*c*, 155*d*, and 155*e* are used, they are preferably visually aligned with the bingo balls they correspond with so that the player can expeditiously daub the desired spots/balls.

If the player has completed his play of the gaming device 100, and he still has a credit amount on the credit meter 140, the player may cash out. To cash out, the player will push a cash out button 180. Depending on the gaming device 100 configuration, the gaming device may pay out coins into a coin tray 190 corresponding to the amount shown on the credit meter 140. Alternatively, the gaming device 100 may issue a ticket from the wager accepting mechanism 110 corresponding to the amount shown on the credit meter 140 or the gaming device 100 may electronically transfer the credit amount to a smart card or a player's account.

Figure 2:
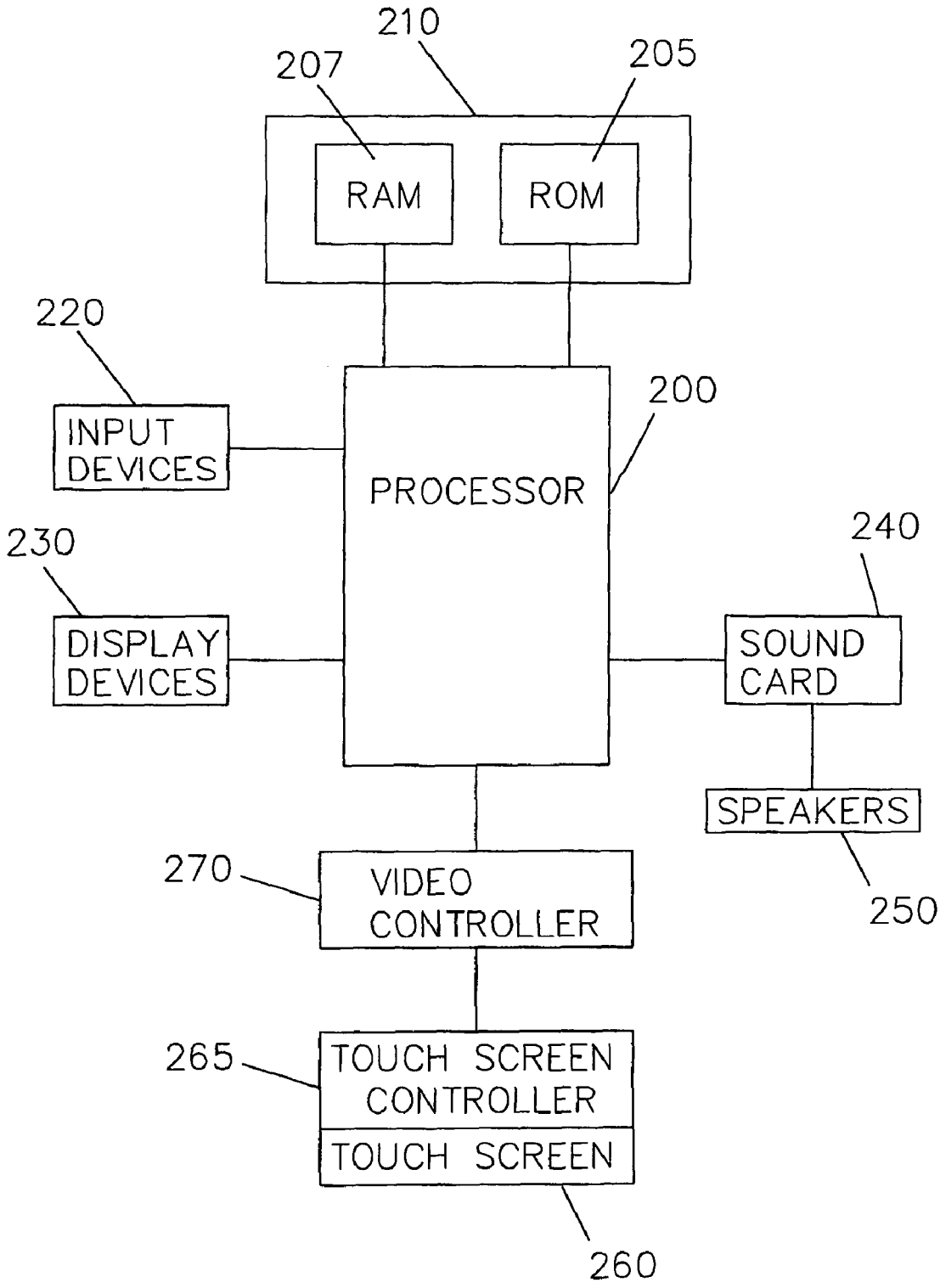
FIG. 2 is a schematic diagram of the electronic configuration of an embodiment of the gaming terminal shown in FIG. 1.

FIG. 2 is a block diagram of the general electronic configuration that may be incorporated in gaming device 100. The configuration preferably includes a processor 200. The processor 200 is preferably a microcontroller-based platform or microprocessor which is capable of displaying images, symbols and other indicia such as images of people, characters, places, things and faces of cards. One or more secondary processors may also be employed in conjunction with the primary processor to control certain aspects of the game function.

The gaming device 100 also includes a memory device 210 for storing program code or other data. This memory device 210 can include both a read only memory (ROM) 205 and a random access memory (RAM) 207. In addition to the memory device 210, the electronic configuration of the gaming device 100 may also include one or more input devices 220, one or more display devices 230, a sound card 240 and one or more speakers 250.

The input devices 220 include but are not limited to play button 145, bet one credit button 170, the daub buttons 155*a*, 155*b*, 155*c*, 155*d* and 155*e*, the max bet button 150 and the cash out button 180. In situations where a touch screen 260 is used, a touch screen controller 265 and touch screen 260 are connected to a video controller 270 and the processor 200.

Although FIG. 2 shows the processor 200 and memory device 210 residing on the gaming device 100, it should be appreciated that it is possible for both the processor 200 and memory device 210 to reside at a central location instead of at the gaming device 100. In such a situation, a network server may be used to communicate to a playing station over an Internet connection, local area network (LAN), or wide area network (WAN). The processor 200 and memory device 210 are generally referred to herein as the controller.

Figure 3:
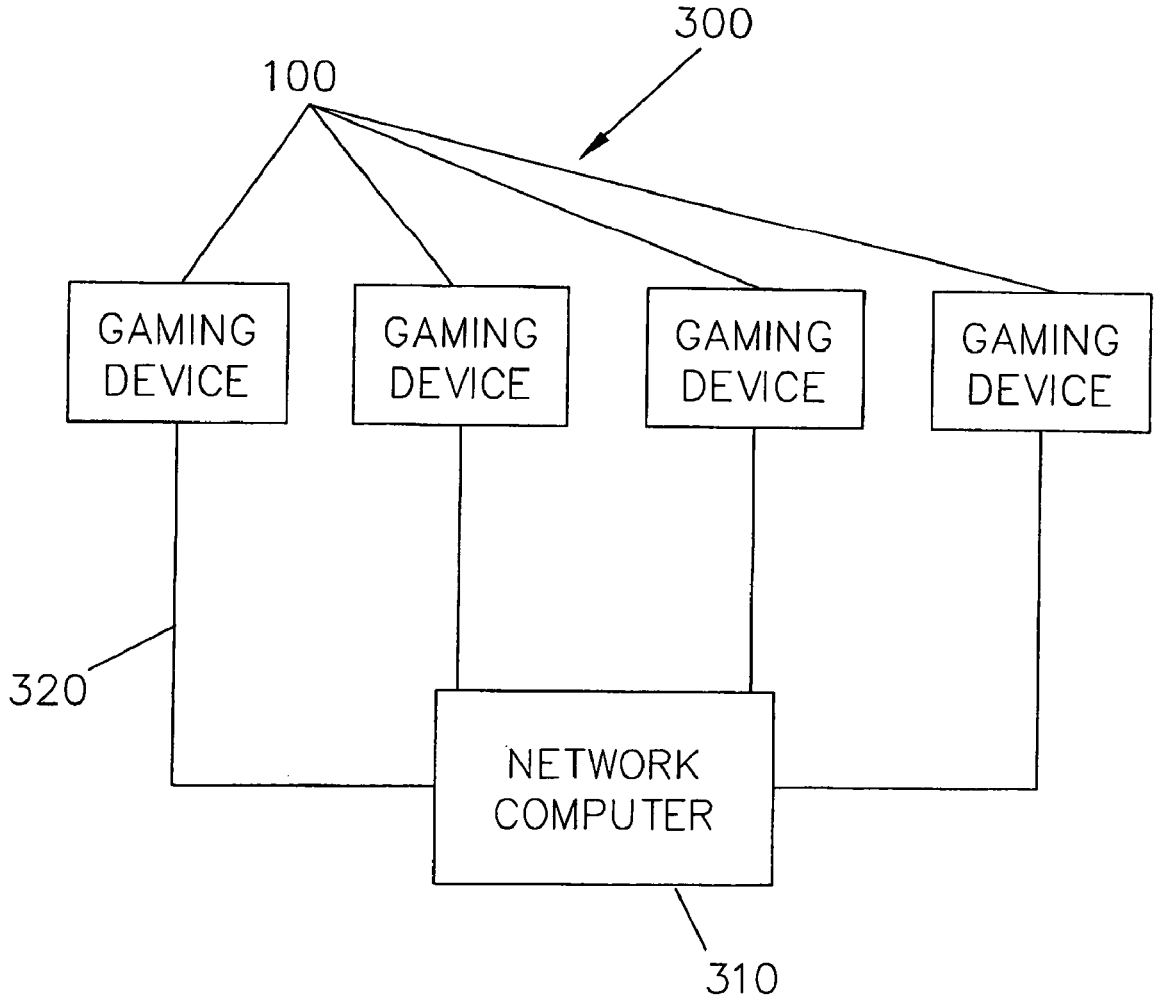
FIG. 3 is a schematic diagram of a plurality of electronic gaming terminals connected to a network computer for playing a bingo game according to the method of the present invention.

FIG. 3 displays a gaming system 300 in which multiple gaming devices 100 are connected to a central or network computer 310 via a network data link or bus 320. The gaming system 300 may include a second group of gaming devices 100 which are connected to another central network computer (not shown) via another network data link or bus (not shown). The first and second gaming systems 300 may be coupled to one another via any type of network known in the art including, but not limited to, the Internet, a wide area network (WAN) or a local area network (LAN).

When play is initiated, the processor randomly assigns a unique number from the appropriate group to each position in the bingo card. In an alternate embodiment, the player may chose the numbers assigned to each position on the card. Often, one or more positions are displayed as "free" indicating that the free position will always be treated as daubed for the game.

Figure 4A:
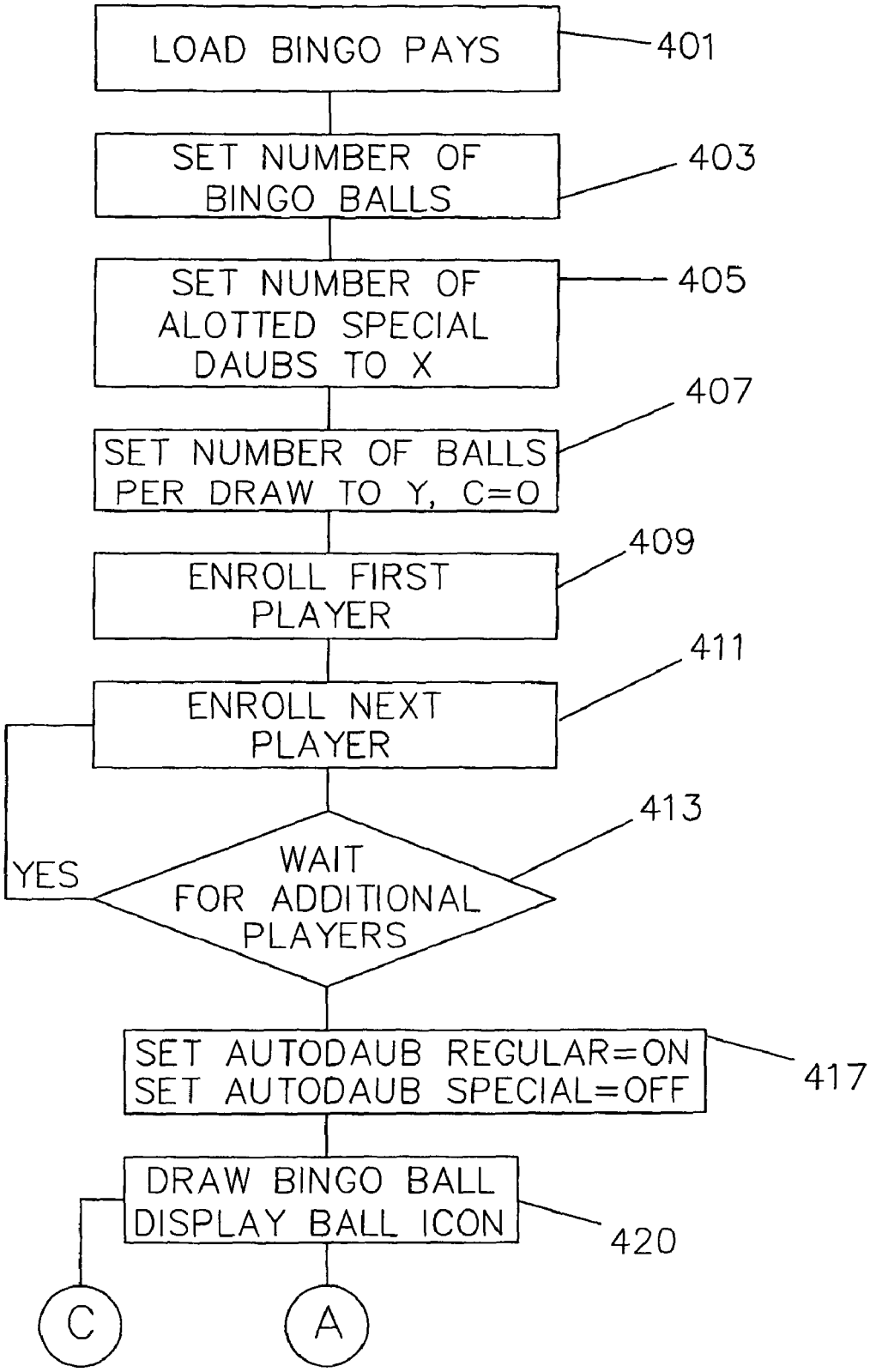
FIGS. 4A-4C is a flow chart showing the steps according to one embodiment of the present invention.
Figure 4B:
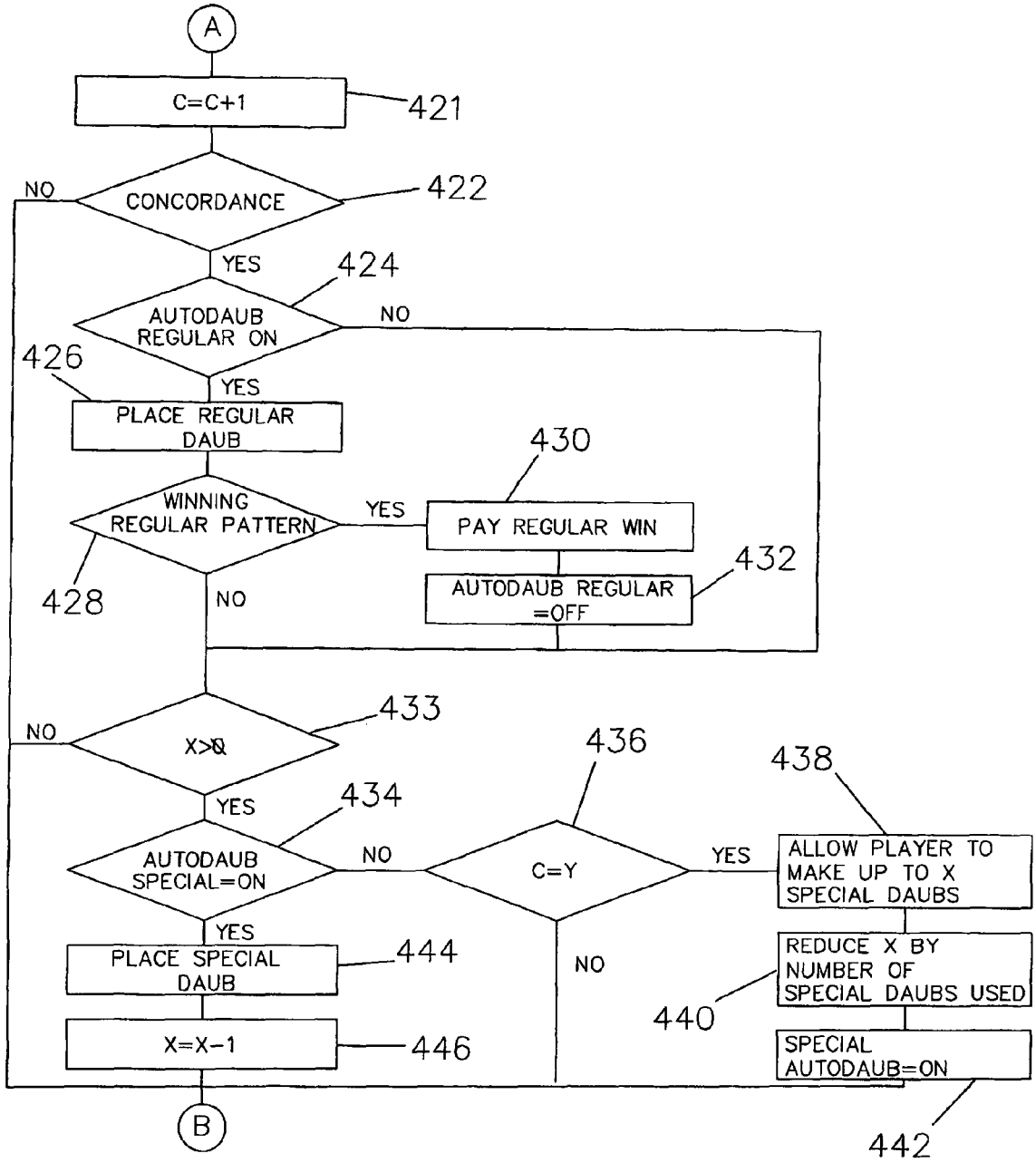
Figure 4C:
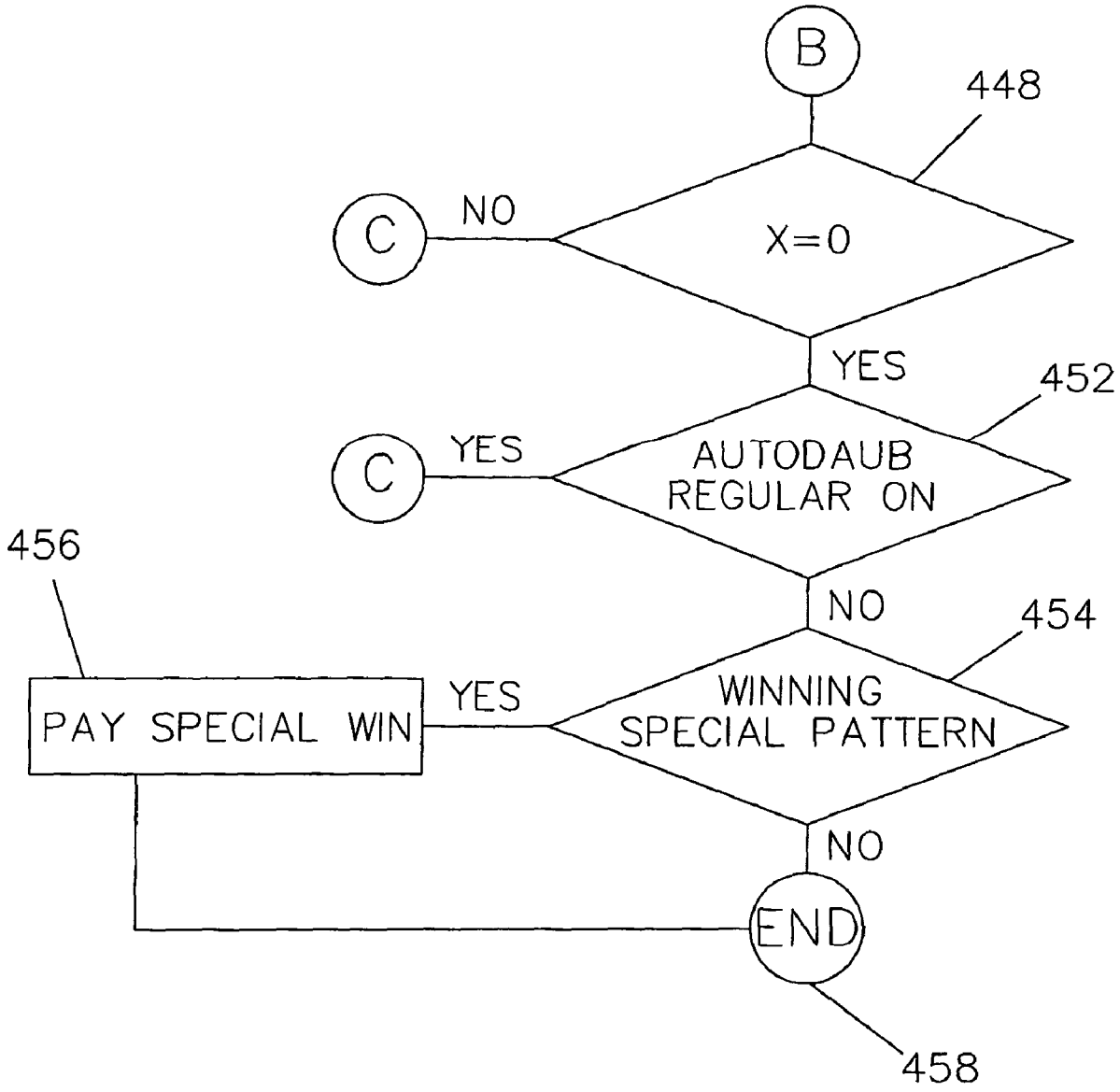
Figure 7:
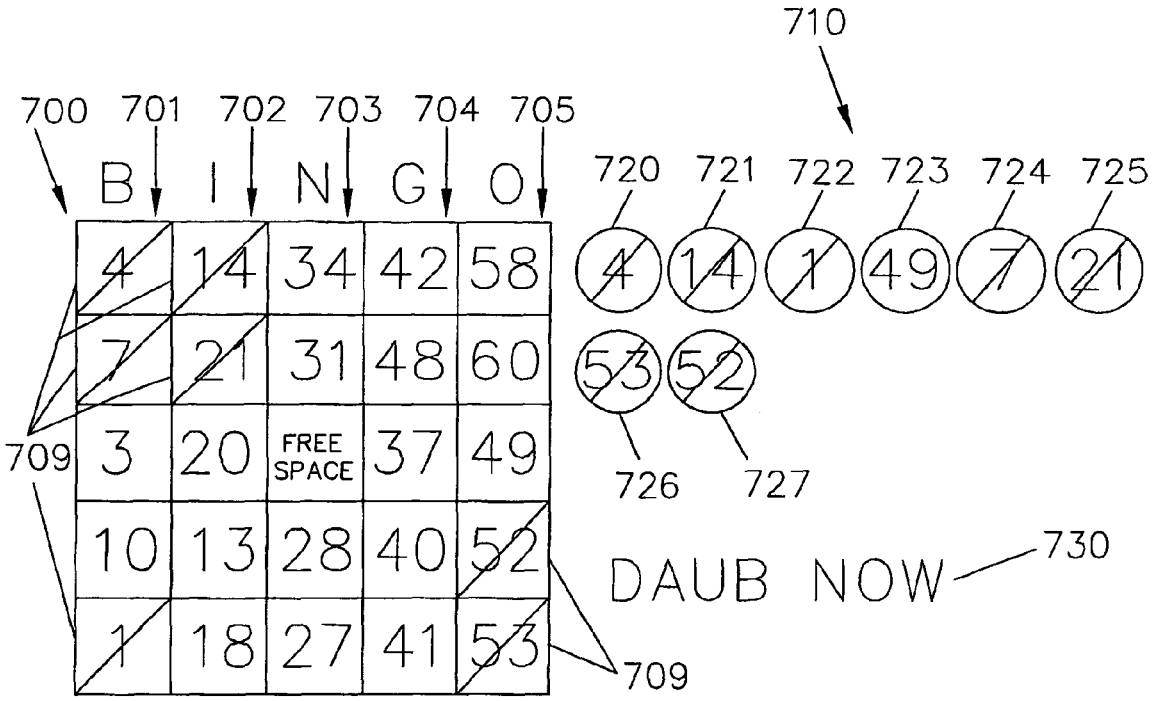
FIG. 7 shows a game of the present invention being played after the initial ball draw employing the pay table patterns defined in FIG. 6.
Figure 8:
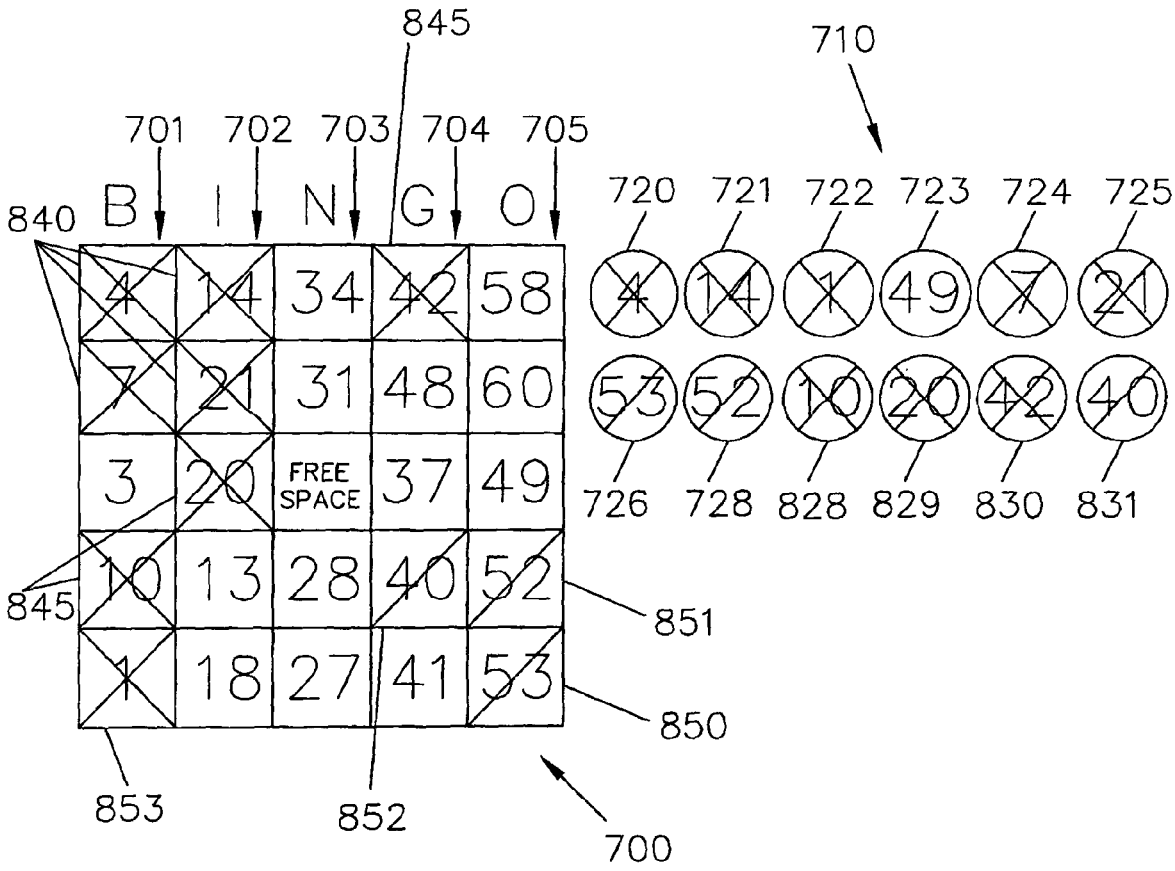
FIG. 8 shows the final result of the game initially depicted in FIG. 7.

Turning now to FIG. 4A-4C and FIGS. 6 to 8, a first embodiment of the present invention will now be described in greater detail. In this embodiment, two different types of daubs, arbitrarily named special daubs and regular daubs, are used. Each type of daub may have its own associated bingo patterns, special patterns and regular patterns, that may be the same patterns or different patterns. Each bingo pattern, whether special or regular, may have a different payout associated with it. FIGS. 4A-4C is a flowchart of one manner of operating the gaming routine. FIG. 6 is an image of a "See Pays" screen that may be displayed and used in conjunction with the manner of operation shown in FIGS. 4A-4C. FIGS. 7 and 8 show the information conveyed to the player by the video display device 105 and/or 107 at various points during the game.

Referring to FIG. 4A, the gaming routine may begin at block 401 at which the gaming system 300 loads the bingo patterns that will result in a winning pay as well as the amount of each winning pay. These winning pays may vary depending on the bingo game, the number of players playing and may also vary depending on the size of each individual player's wager. Although the patterns used for special daubs and regular daubs are the same in this example, this is a matter of convenience only and different patterns may be used for the two different sets of daubs. Preferably the pay information is relatively constant such that players can easily predict what patterns and associated pays they are playing for from game to game. The pattern and pay information may be communicated to the player via a "see pays" screen 601 as shown in FIG. 6. At block 403 the total number of bingo balls available for drawing for the game is determined. Referring to FIG. 6, in the "rules" section 655 of the "see pays" screen 601, it is apparent that the total number of bingo balls available for drawing has been set to sixty. At block 405 the gaming system 300 determines the number of allotted special daubs each player will initially receive. Referring to the rules section 655, it is apparent that for this game the number of special daubs has been set at eight. At block 407 a counter for tracking the number of bingo balls drawn, C, is set to zero and the number of balls to be drawn in the first draw is set. Again referring to the rules section 655, it is apparent that the number of balls per draw has been set to eight. Although steps 401, 403, 405 and 407 relating to the setting of the bingo game's basic parameters are shown as coming before the enrollment of any player in block 409, it should be understood that this is not necessary. Indeed as already disclosed, in many applications, these parameters may change depending upon the number of players enrolled or the size of the various wagers enrolled. Thus, it should be understood that although performing certain steps of the invention in the described manner may be desirable, unless specifics of the invention dictate otherwise, these steps may also be performed in any order.

At block 409 a first player is enrolled in the game. In the electronic version of the game, it will be appreciated and understood by those familiar with the gaming art that enrolling a player in the game may include the steps of the player establishing credit at an electronic gaming terminal 100 by either depositing currency in the form of bills or coin or by using other value-accepting mechanisms associated with the gaming terminal 100. These may include a bill/ticket validator 110, coin slot 120 or card reader 130. Once credit is established, the player may enroll in the game by indicating the amount of his wager using various player input mechanisms and pressing start or draw button 145 or similar input means. After the first player is enrolled at block 409 the gaming system 300 waits for at least a second player to enroll at block 411. The gaming system 300 may wait for additional players to enroll using algorithms well known in the electronic bingo art as indicated at block 413. These algorithms may be very simple, for instance waiting for a predetermined number of players, e.g., four, or waiting a predetermined amount of time to enroll as many players as possible, e.g., thirty seconds. Alternatively, the algorithms may be much more complex and may vary the number of players or the time window for enrollment based upon how many terminals are in active use across the gaming system's 300 network. It may be desirable for the gaming system 300 to communicate to the players the total number of enrolled players using display device 105 or 107 or some other communication device. Also during enrollment, each player may be issued at least one bingo card 700 similar to the one shown in FIG. 7.

The bingo card has a first column 701, labeled B, a second column 702, labeled I, a third column 703, labeled N, a fourth column 704, labeled G, and a fifth column 705, labeled O. The bingo card 700 will preferably have numbers corresponding to the total number of bingo balls available for drawing. The numbers will preferably be randomly distributed on the bingo card 700, but the player may be allowed to exercise a degree of control over the numbers he is assigned and how they are arranged using the various player input means provided. In the non-electronic form of the invention, the step of enrolling players is typically performed by selling a player a bingo card that bears an indication of which bingo draw it is good for.

Referring again to FIG. 4A, at block 417 another game parameter is set. In this example, block 417 turns autodaub ON for regular daubs ("Regular Autodaub") and turns autodaub OFF for special daubs ("Special Autodaub"). As will be seen, setting these two autodaub features in this fashion will result in two bingo games being played simultaneously. In the first game dealing with regular daubs, all of the spots on each player's card 700 corresponding to a drawn bingo ball will automatically be daubed until one player achieves a regular bingo pattern (which may also be referred to as a game-ending bingo pattern), at which point the regular aspect of the bingo game will be terminated. In the second game dealing with special daubs, the player will initially be given the option of which of the available spots to daub as groups of bingo balls are drawn. But in subsequent draws, the player's remaining special daubs that were unused in the initial draw or draws will be automatically used in an autodaub format for the subsequent spots until such time as each player's allotted special daubs are completely used.

Autodaub or automatically daubed as used herein refers to any electronic means that automatically keeps track of spots available for daubing on a player's bingo card and that daubs all of these available spots without giving the player the option to daub some individually selectable spots. Some forms of autodaub being used in electronic bingo games today require a player to periodically hit a button to initiate an autodaub. Upon doing so, all spots available at that time are daubed. The player may have to hit this button to initiate the autodaub on later occasions throughout the game to effectuate a daubing of spots that match with newly drawn balls. Although such routines allow a player to selectively autodaub groups of available spots, they do not allow a player to daub some of the spots in these groups and not others. Therefore, each such application is still within the meaning of autodaub as used herein.

At block 420 a bingo ball is drawn by the network computer 310 and communicated to each player's game terminal 100. Each player's game terminal 100 will display the drawn ball in a ball display area 710, e.g., with a ball display icon 720 on FIG. 7. In FIG. 4B at block 421 C is incremented by one to reflect that a ball has been drawn. At block 422 the gaming routine determines if there is a match between the recently drawn ball and any of the spots on each player's bingo card 700. Preferably this operation is carried out by the processor 200 in the individual gaming terminals 100 and communicated to the network computer 310. When there is a match, the gaming terminal's display device 105 or 107 preferably may provide a visual indication of such by highlighting an available spot 709 on the player's bingo card 700 and/or by highlighting the ball display icon 720 in the ball display area 710. Of course, a variety of visual indications may be used. At block 424, the game routine determines if Regular Autodaub is ON. If it is ON, this indicates that a regular bingo pattern has not yet been formed using regular daubs. If Regular Autodaub is OFF, no daubing of regular spots can occur in the embodiment shown and the gaming routine will proceed to block 433 dealing with special daubs. Preferably the Regular Autodaub function is set the same at all times for all gaming terminals 100 playing the bingo game. Thus, in this embodiment the player's are competing against each other to be the first to complete a regular bingo pattern using regular daubs. Assuming that Regular Autodaub is ON, the matching spot 709 on each player's bingo card 700 is daubed with a regular daub as indicated at block 426. At block 428, the logic of the gaming system 300 determines if the last ball drawn completes a regular bingo pattern using regular daubs. If it does, the player or players (if multiple patterns are completed using the same final ball) are paid for the regular pattern win at block 430. In order not to interrupt the flow of the game, it may be desirable to provide the win to the player at the ultimate end of the game, however. After a pattern has been completed with regular daubs, the Regular Autodaub is turned OFF at block 432.

After the gaming routine of the present invention has dealt with application of regular daubs, it proceeds to block 433, which begins the portion dealing with special daubs. At block 433 the routine determines if there are any unused special daubs remaining. The determination of whether a player has any special daubs remaining unused will preferably be made by the processor 200 in each individual player's game terminal 100 as the usage of the special daubs is intended to be a strategic decision made by each individual player. If there are remaining unused special daubs (i.e., if X>0), the routine proceeds to block 434 to determine whether Special Autodaub is ON. Because this parameter is preferably set to OFF in block 417 at the beginning of the game, the routine will initially proceed to logic block 436. At block 436 the routine determines if the last drawn ball completes the set of balls to be drawn (i.e., if Y=C). If it does not, additional balls are preferably drawn to complete the set.

If the last drawn ball does complete a selectable set, the gaming routine proceeds to block 438 where the player is then allowed to use some, none or all of his special daubs on the balls in the set. Referring now to FIG. 7, the terminal's display screens 105 or 107 may at this point display a message 730 notifying the player that he may now make his selection. As previously discussed the balls in the set that have been drawn are also preferably displayed by a plurality of ball display icons 720, 721, 722, 723, 724, 725, 726 and 727 and the balls in this set that concord with a spot on the player's bingo card 700 are preferably highlighted in some fashion as are the matching spots 709 on the player's bingo card. The player may make his selection by using a touch screen, light pen, buttons or the like to indicate either the available spots 709 or the matching ball display icons (ball display icons 720, 721, 722, 723, 724, 725, 726 and 727). After a player has made his selections and is satisfied with them, he preferably actuates a "Continue Draw" button 145 that indicates his desire to proceed with the bingo game. At this time the player's allotment of special daubs is reduced by the number just used as indicated at block 440.

At block 442 the Special Autodaub is switched to ON. This signifies that at this point in the game, any remaining special daubs will automatically be used on any additional available spots as additional balls are drawn without giving the player the option to strategically decide not to daub them. It will be appreciated by those familiar with gaming that it may be desirable to determine if any player has completed a special bingo pattern using special daubs as soon as the Continue Draw button 145 is activated. In some alternative embodiments, only the first player to complete a special bingo pattern with special daubs may receive an award to heighten the competition among the players. Also, it will be appreciated that a player may be allotted more than eight special daubs, but then because balls are drawn in sets of eight, it may be possible for a player to have more than eight special daubs remaining after the first set is evaluated. In such a situation, it may be desirable to draw another set of eight balls and allow the player to strategically decide for which of the resulting available spots to use special daubs. Thus, in this alternative embodiment, the Special Autodaub in not set to ON until the player has fewer special daubs remaining than the number of balls drawn per set. Alternatively, the Special Autodaub can be set to ON after a predetermined number of ball sets other than the first one have been drawn. Setting Special Autodaub to ON can optionally be done either on an individual gaming terminal 100 or across all gaming terminals 100 playing the current bingo game by the network computer 310. It will be appreciated by those skilled in the art that the options of only awarding the first special bingo pattern formed with special daubs, allowing Special Autodaub to remain OFF for a second (or further) set of balls and allowing Special Autodaub to be switched to ON for some terminals but not others can be used in various combinations to provide players a variety of interesting and entertaining options. Each option offers a different strategy and level of competition between the players.

After the Special Autodaub is turned ON, additional available spots will be automatically daubed as indicated at block 444 until the number of special daubs remaining is reduced to zero via block 446. Referring now to FIG. 4C and to logic blocks 448 and 452, collectively these blocks determine whether additional balls need to be drawn either to ensure at least one player completes a regular pattern with regular daubs or to allow each player to use his allotment of special daubs. Of course, in the alternative embodiments discussed in the foregoing paragraph where there is no guarantee that a player will use all of his special daubs or where players compete to be the first to complete a special bingo pattern using special daubs, block 448 is adjusted accordingly. At logic block 454 the gaming routine determines if a player has completed a special bingo pattern using special daubs and, if so, pays the player for the special win at block 456.

Referring now to FIG. 8, it is apparent that the player chose to use special daubs on available spots 840 and 853 but not on available spots 850 and 851 when given the opportunity in the flowchart at block 438. To signify that available spots 850 and 851 have been marked with regular daubs, but not special daubs, different graphic patterns may be used on the bingo card 700 and in the section of the video display 105 or 107 showing the drawn balls 710. In the instant example a regular daub is indicated by a / hash mark, a special daub is indicated by a \ hash mark and a spot with both daubs is indicated by an X. The decision not to daub the spot 850 corresponding to drawn ball number fifty-three is mathematically and strategically the correct choice because the most likely pattern the spot 850 would be used to complete is the diagonal traversing from the upper left corner to the lower right corner. To complete this pattern, the player needs ball number forty. However, if ball number forty is drawn, the player would also complete a kite pattern resulting from balls four 720, fourteen 721, twenty-one 725 and seven 724 as well as the "Free Space" in the center of the 5×5 matrix. As the kite pattern pays a greater number of credits, the diagonal pattern would be ignored per the rules in FIG. 6. Because the player chose not to daub the spot 850 corresponding to ball number fifty-three, it was also logical for the player to not daub the spot 851 corresponding to ball number fifty-two.

Note that the player also chose to daub the spot 853 corresponding to ball number one. Based on the pay table shown in FIG. 6 and the statistical expected value of this decision, this was not the mathematically optimal play. The odds of this spot 853 being used to complete the bottom-left to top-right diagonal with three special daubs remaining is 0.005%. The odds of this spot 853 being used to complete the vertical line in the B column 701 is 0.226% and the odds of the player catching ball number forty to complete the kite with three special daubs remaining (the number of daubs the would remain if the spot 853 is daubed) is 5.769%. Thus, the expected value of patterns resulting from daubing this spot and the kite is 0.00005×3 (the pay for a diagonal)+0.00226×7 (the pay for a vertical)+0.05769×10 (the pay for a kite), or 0.5929. Whereas, the expected value that the player would receive just for the kite alone, if he had four special daubs in which to complete it, is 7.692%×10, or 0.7692. Thus, by daubing the spot 853 associated with the one ball, the player lost over 0.1763 in expected value. Although this may constitute an error in mathematical strategy, it is still a strategic decision as contemplated by the invention.

Again referring to FIG. 8, the outcome of the decisions that the player made at block 438 in the game routine after the initial eight bingo balls were drawn can now be determined. The player's bingo card 700 contained a plurality of spots 845 corresponding to the next three bingo balls drawn in the second drawing as indicated by ball icons 828, 829 and 830. Therefore these spots 845 were autodaubed with regular daubs as indicated at block 426 and with special daubs as indicated at block 444. The player's remaining number of special daubs was reduced by one for each spot at block 446. Thus the first three balls drawn in the second draw used up all of the player's allotted special daubs. It will be appreciated that in an alternative embodiment, it may be desirable once the Special Autodaub is ON to reduce the player's number of special daubs by one for every ball drawn, regardless of whether there is a match between the drawn ball and a spot on the player's bingo card 700. Because the first three spots 845 that were covered using the player's remaining special daubs did not complete a special bingo pattern, the player did not receive any special pays. However, the fourth bingo ball drawn in the second drawing as indicated by a ball icon 831 was ball number forty. A spot 852 matching ball number forty was autodaubed with a regular daub as indicated at block 426 and completed the pattern forming a kite using regular daubs. And because the Regular Autodaub was still set to ON, indicating no other player had yet formed a regular bingo pattern, the player would be awarded five credits at block 430 as indicated by the pay table shown in FIG. 6. Note, had the player not used a special daub to daub spot 853 corresponding to bingo ball number one, the drawing of bingo ball number forty would have also completed a special bingo pattern using special daubs, in which case the player may have been awarded both ten credits for the special win and five credits for the regular win. Alternatively, the rules for the game may be adjusted so that the player is only awarded for a single win, in this case the ten credits for the special win, as the highest win, would be the preferred payout.

Using the same principles of expected value demonstrated above, it will be appreciated by those skilled in the art that once the number of players in a given bingo game is known, the total expected value for any given player at any time can be determined or approximated by reviewing the rules of the game, particularly those displayed in FIG. 6, and the status of the ball draw compared to each player's bingo card 700. Further, it will be appreciated that the expected value will be comprised of two components. The first component comes from the bingo pays that use regular daubs and is therefore entirely based on luck. The second component comes from the bingo pays that use special daubs and is therefore based at least in part on the player's strategic decisions as well as luck. By adjusting the payouts for the various patterns, the expected value of both the regular pays and the special pays can easily be adjusted. Preferably the two components when added together will produce an expected value greater than 0.75 but less than 1.00 (because an expected value above 1.00 would mean that with perfect strategy, the house may lose money in the long term). Furthermore, most preferably the total expected value will be greater than 0.95, of which more than 0.90 is attributable to the special pays. In terms of a ratio the expected value of the special pays to the expected value of the regular pays will be greater than approximately 20:1, and most preferably greater than approximately 40:1.

It will be appreciated that in addition to the variations to the gaming routine described in FIGS. 4A-4C that have already been disclosed, other variations are made possible merely by adjusting the parameters of the game such as the number of allotted special daubs set at block 405 and the number of bingo balls drawn per group set at block 407. For instance, in one alternative embodiment the number of allotted special daubs could randomly change at some point in the game. This would in turn alter the expected value of special daubs that the player could have used, but chose to save. Also, it may be possible to allow the player to "purchase" additional special daubs at some point in the game by increasing his wager. The "price" of these special daubs need not be constant and could change in either a predictable or random manner. Preferably, the price of the special daubs would increase as the game is played. Thus, referring to the example shown in FIG. 6, one credit initially purchases eight special daubs. Therefore, in this alternative embodiment it would be preferable to allow the player to purchase less than eight special daubs for one credit. Additional special daubs could be purchased either one at a time or in groups. Also, by changing the number of bingo balls drawn per group, the decisions made by the player would significantly change. For instance if Y is set to one at block 407, the player may be presented with only one bingo ball at a time and would have to decide whether to daub it based on which balls were previously drawn without seeing any other balls that will be drawn. While if Y is greater than one, the player gets to evaluate a larger group of balls, but may be limited to selecting only one ball out of each group by resetting the allotted special daubs to one before each group of balls is drawn. Also, while the special daubs and regular daubs were simultaneously used in the described embodiment, it would of course be possible to first use either special daubs or regular daubs for one or more ball draws and then use the other form of daub for additional ball draws.

Referring now to the flowchart in FIGS. 5A-5C and FIGS. 9 to 12, another alternative embodiment will now be described. Among the features of this embodiment that differ from the embodiment described in FIGS. 4A-4C is that there is only one type of daub. The player is initially limited to the number of daubs he is allotted, but if no player completes a game-ending pattern in the allotted daubs, additional daubs are allotted to every player and autodaubed as additional balls are drawn until there is at least one winner. In this embodiment a great premium may be paid for completing a pattern in the original allotment of balls. Also different from the embodiment previously described is the addition of ancillary indicia, in the form of playing cards, that are not traditionally associated with the game of bingo. In addition to providing the player with additional visual stimulus, the playing cards allow the player to quickly and more accurately evaluate the strategic decisions available to the player after the initial group of bingo balls is drawn and simulates to the player a game of five-card-draw video poker.

Figure 5A:
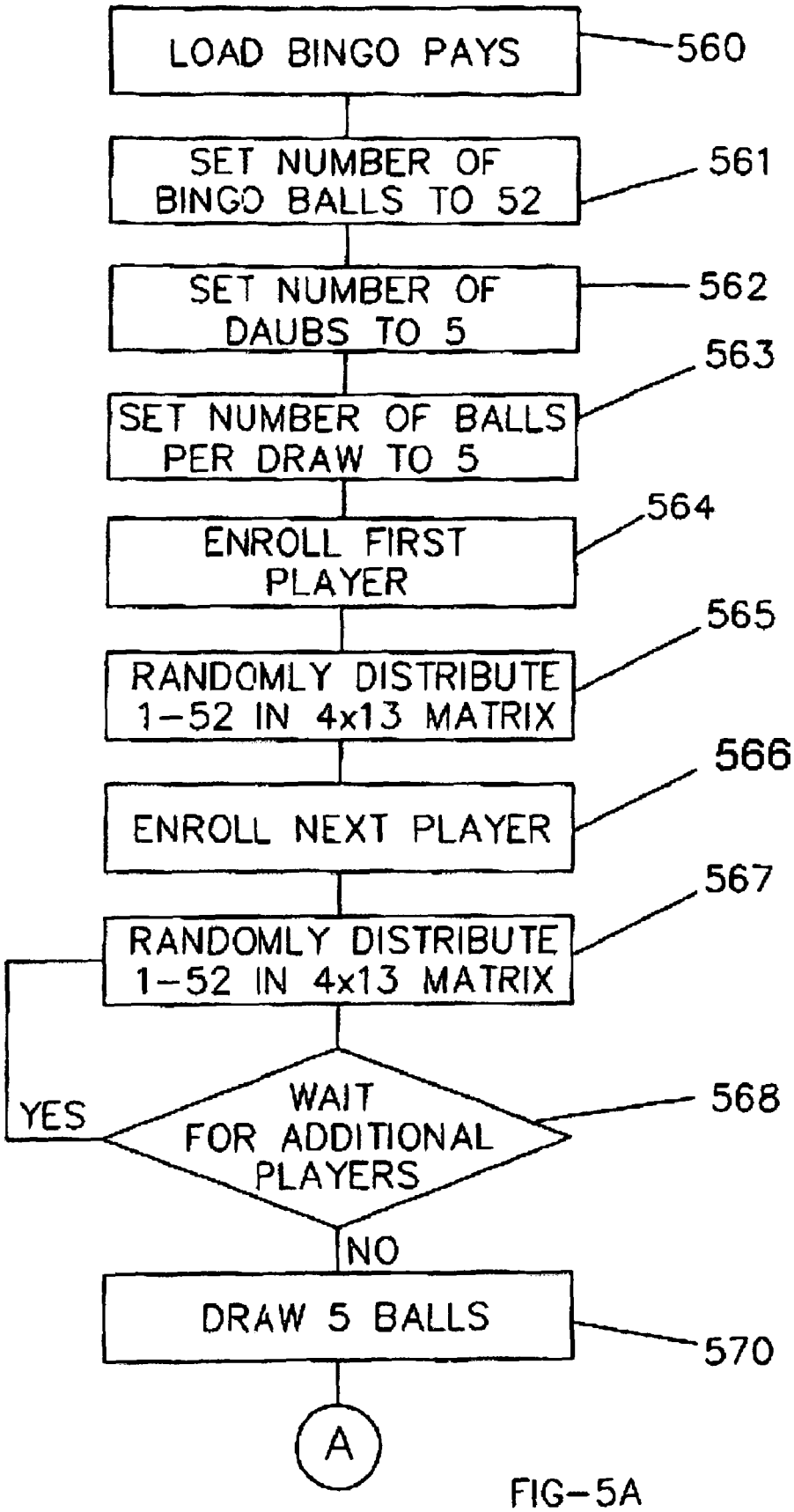
FIG. 5A-5C is a flow chart showing the steps according to an alternative embodiment of the present invention.
Figure 5B:
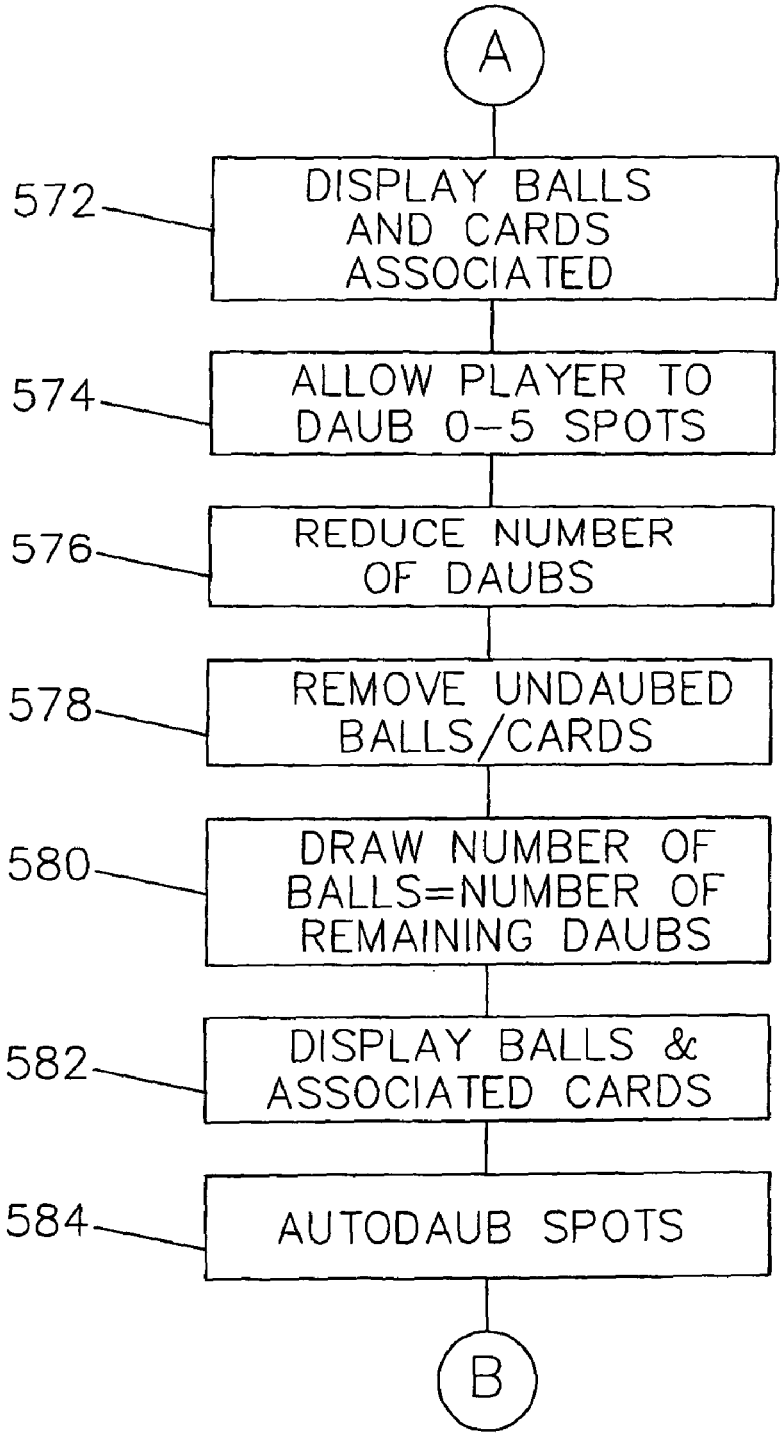
Figure 5C:
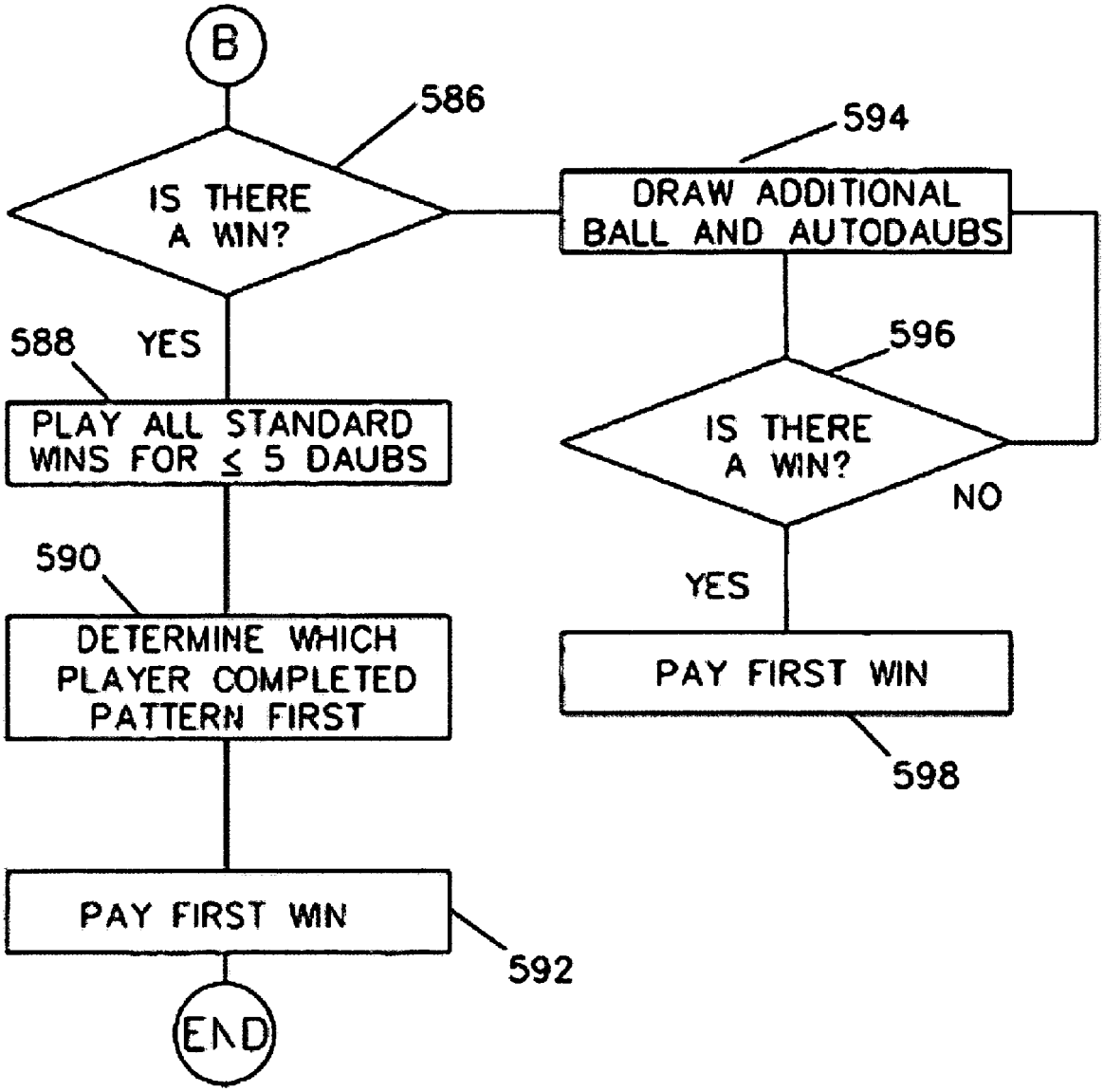

In FIG. 5A, at block 560 the gaming routine of the present embodiment may be initiated by loading the pay table information shown in FIG. 9. At block 561 the total universe of bingo balls to be used in the game is set at fifty-two balls numbered one to fifty-two. At block 562 the number of daubs originally allotted to the player is set at five and at block 563 the number of balls to be drawn in the initial group is set to five. It is understood that, as was done in FIGS. 4A-4C, each of these values can be replaced with a variable and data structure that is easily changed from game to game.

Figure 10:
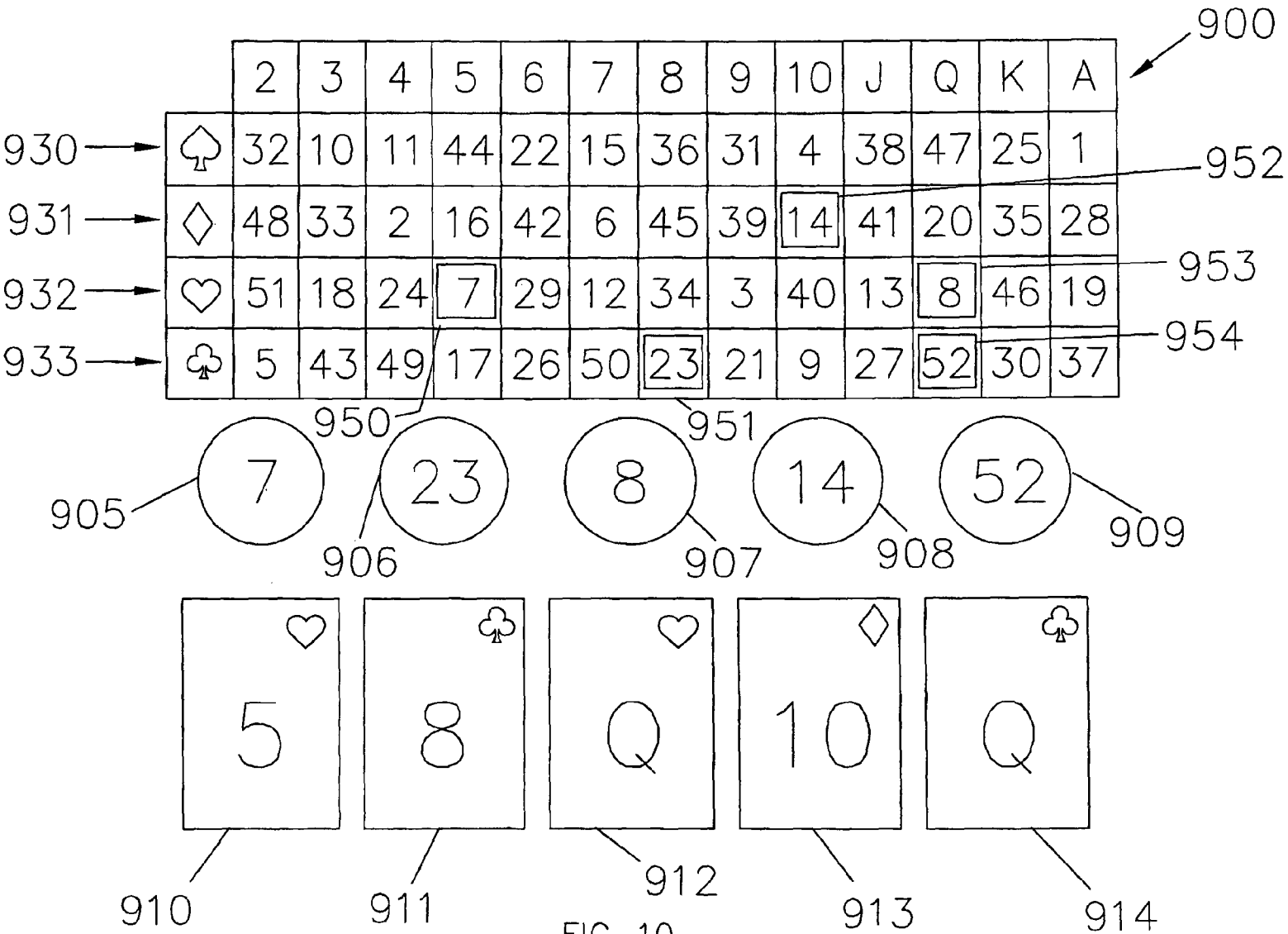
FIG. 10 shows a game of the present invention being played by a first player after the initial ball draw employing the pay table patterns defined in FIG. 9.
Figure 11:
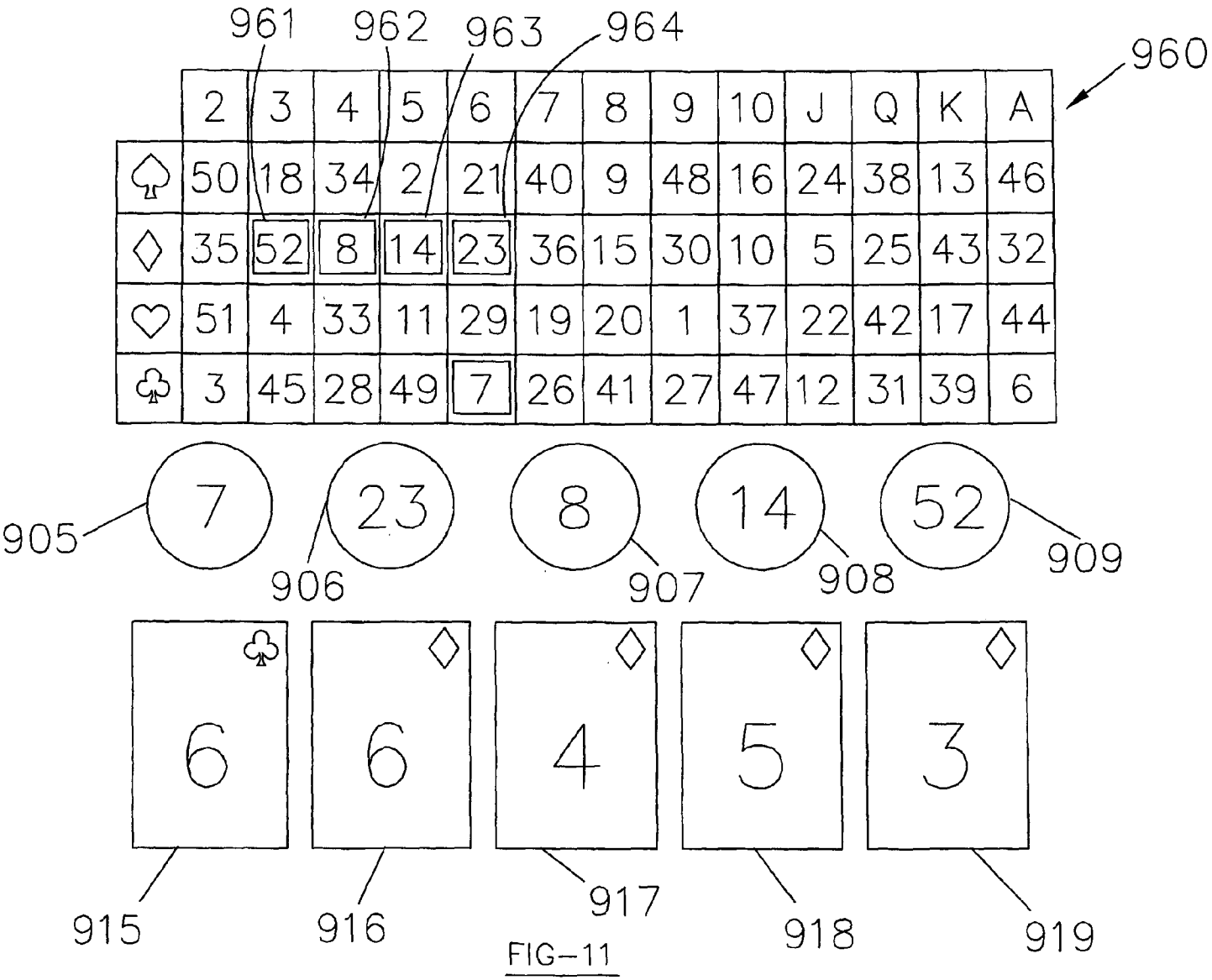
FIG. 11 shows a game of the present invention being played by a second player after the initial ball draw employing the pay table patterns defined in FIG. 9.

At block 564 the gaming system 300 enrolls the first player by accepting a wager at the player's gaming terminal 100. As part of the enrollment process the gaming system 300 may randomly distribute numbers one to fifty-two in the matrix of a first player's bingo card 900 at block 565 as shown in FIG. 10. The random creation of the bingo card 900 may be done locally by the gaming terminal 100 or by the network computer 310. In either case, it is preferable that the gaming system 300 ensures that no two players' bingo cards 900 are identical. Each bingo card has a plurality of rows 930, 931, 932 and 933. The suit of the playing card (i.e., Spades, Diamonds, Hearts or Clubs) associated with each spot is determined by assigning each of the four rows 930, 931, 932 and 933 of the bingo card 900 a suit. Similarly, the rank of the playing card (i.e., Two through Ten, Jack, Queen, King and Ace) is determined by assigning each column of the player's bingo card 900 a corresponding rank. Preferably, the rank associated with each column and the suit associated with each row is in a logical order and is constant from game to game. At blocks 566 and 567 the gaming system 300 enrolls an additional player by accepting a wager at an additional gaming terminal 100 and randomly generates an additional bingo card 960 as shown in FIG. 11. As in block 413 in FIG. 4, the gaming system 300 may wait to enroll other players at block 568.

After all players have been enrolled, the gaming system 300 draws the first group of five bingo balls at block 570. A plurality of corresponding ball icons 905, 906, 907, 908 and 909 are displayed on the video display 105 or 107 of each player's gaming terminal 100. Additionally, as indicated at block 572, based on the matrix position of the spot, if any, corresponding to each drawn ball, a playing card is also displayed on the video display 105 of each player's gaming terminal 100. Referring now to FIG. 10, it can be seen that the first five balls drawn were, in order of drawing, the seven ball, the twenty-three ball, the eight ball, the fourteen ball and the fifty-two ball. These balls correspond to a plurality of spots 950, 951, 953, 952 and 954 respectively of the player's bingo card 900. Therefore, the gaming terminal generates a plurality of playing cards 910, 911, 912, 913 and 914. The playing cards are the Five of Hearts 910, the Eight of Clubs 911, the Queen of Hearts 912, the Ten of Diamonds 913 and the Queen of Clubs 914. Referring now to FIG. 11, it is apparent that these same five bingo balls represent a different plurality of playing cards 915, 916, 917, 918 and 919 on another player's bingo card 960, specifically the Six of Clubs 915, the Six of Diamonds 916, the Four of Diamonds 917, the Five of Diamonds 918 and the Three of Diamonds 919. The difference in the playing cards displayed in FIG. 10 and FIG. 11 is attributable to the different distribution of numbers on the two player's bingo cards 900 and 960.

It will be appreciated that because there are only fifty-two bingo balls in the total number of bingo balls available for drawing and because each bingo card 900 and 960 has fifty-two spots in its matrix, there is no need to check for a match between the matrix and the drawn ball, as was done at block 422 in FIG. 4. Of course, if the parameters of the instant bingo game were changed, this step could be easily inserted.

At this point in the game represented by block 574, each player is allowed to make strategic decisions by selectively daubing between none and all of a plurality of five spots 950, 951, 952, 953 and 954 on his bingo card 900 that correspond to the five bingo balls drawn. This may be done by touching the spots 950, 951, 953, 952 and 954, the bingo ball icons 905, 906, 907, 908 and 909 or the corresponding cards 910, 911, 912, 913 and 914 on the gaming terminal's video display 105. Also, the player may daub spots by depressing one or more of the corresponding "Daub" buttons 155*a*, 155*b*, 155*c*, 155*d* and 155*e* on the gaming terminal 100. Preferably these buttons 155*a*, 155*b*, 155*c*, 155*d* and 155*e* are generally aligned on the gaming terminal 100 beneath the five bingo ball icons 905, 906, 907, 908 and 909 and/or corresponding playing cards 910, 911, 912, 913 and 914 displayed on the video display 105.

Figure 12:
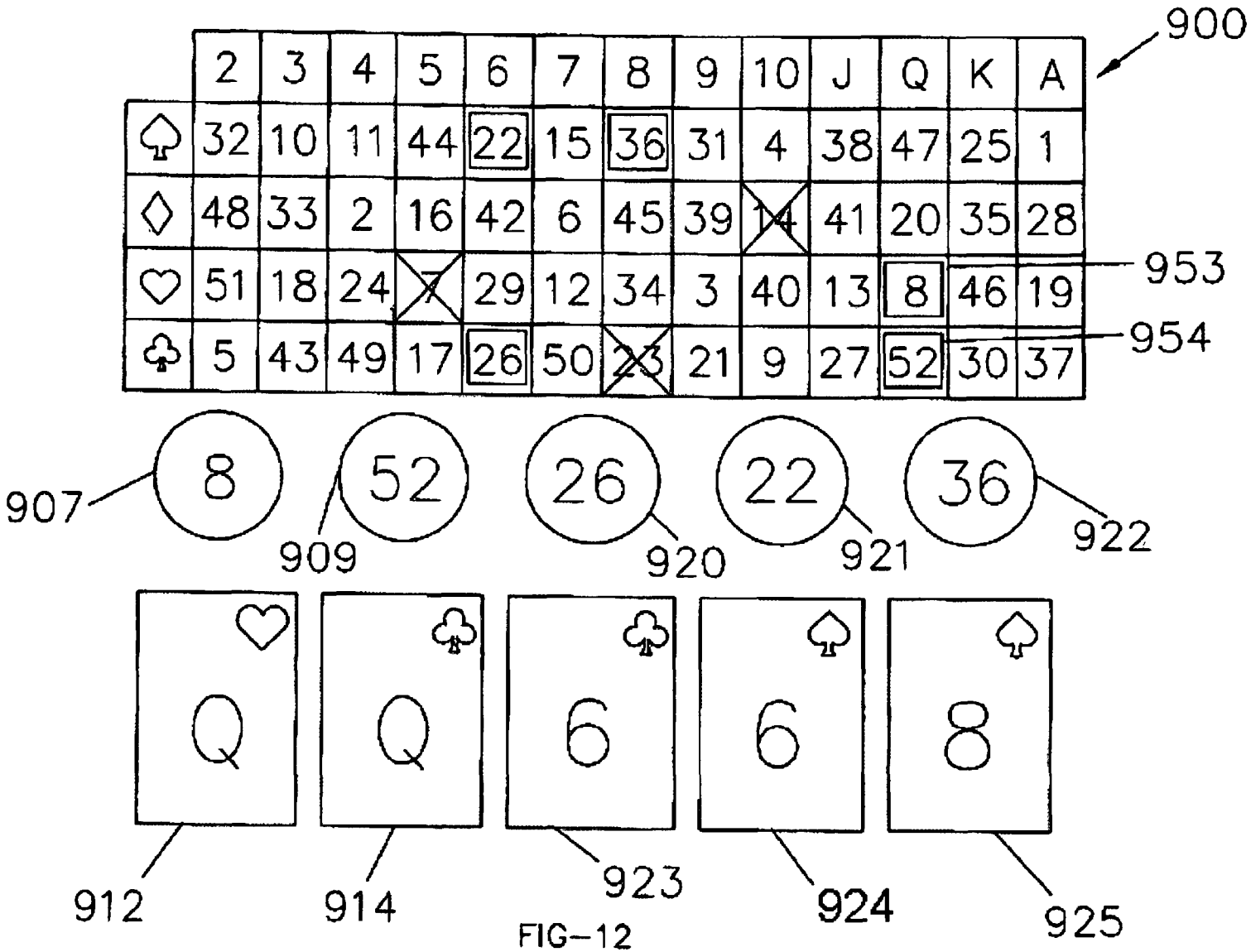
FIG. 12 shows the final result of the game initially depicted in FIG. 10.

After the player is happy with his usage of allotted daubs on the first group of bingo balls drawn, he presses the Continue Draw button 145. At block 576 each player's number of allotted daubs is reduced by the number of daubs just used. Once all enrolled players have indicated their desire to continue with the draw, the gaming system 300 proceeds to block 578. At block 578 the gaming terminal 100 removes the undaubed bingo ball icons 905, 906, and 908 as well as the associated playing cards 910, 911, and 913 from the video display. In an alternative embodiment, it may be desirable to retain on the video display 105 or 107 a record of all bingo balls that were drawn even if they were not daubed. It may also be preferred to rearrange some of the graphics shown to the player on the video display 105 to more easily advise the player of the results of his strategic decisions as shown in FIG. 12.

Figure 13:
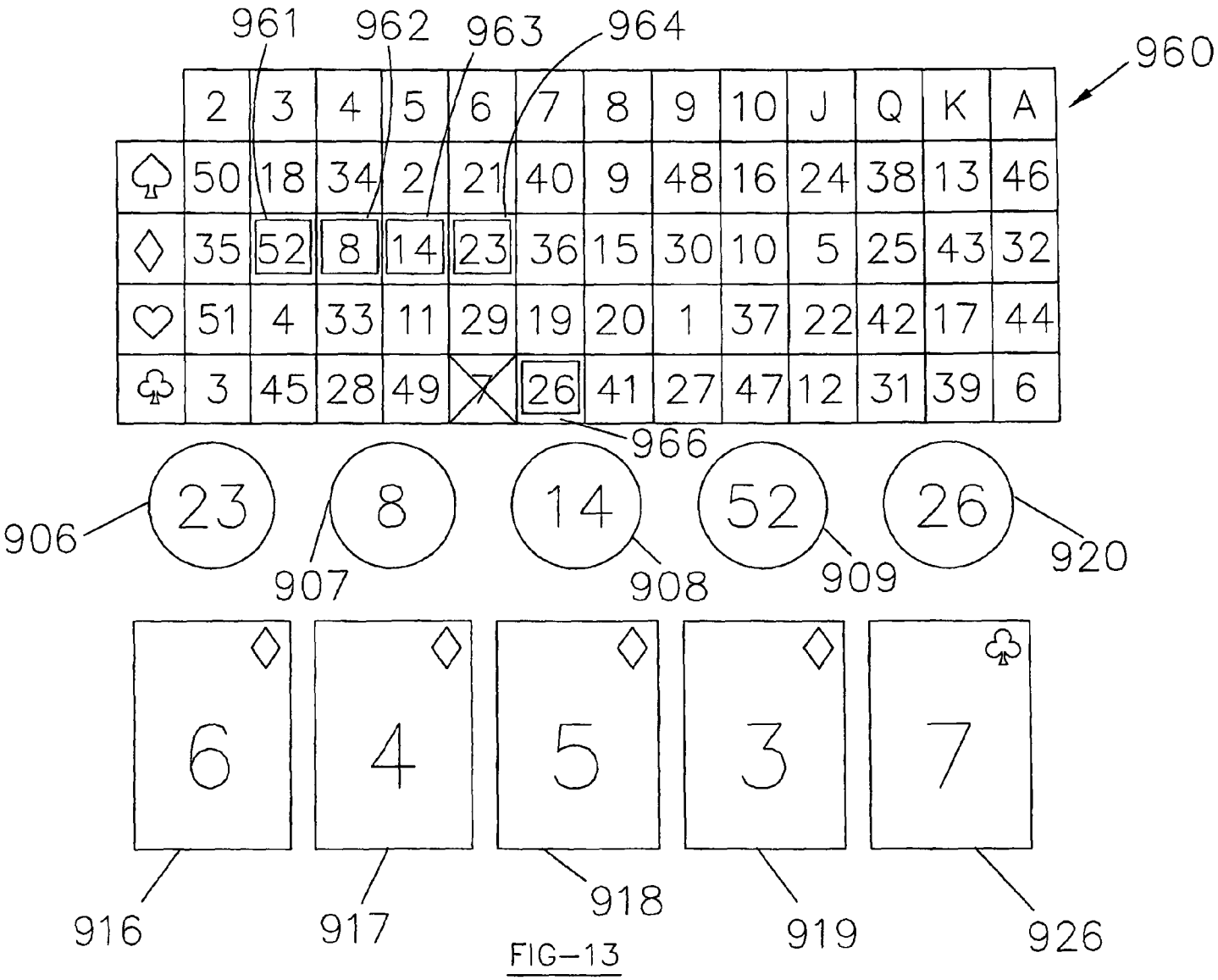
FIG. 13 shows the final result of the game initially depicted in FIG. 11.

At block 580 the gaming system 300 initiates the draw of the second group of bingo balls. For simplicity the second group of balls may be the same size as the first group of balls drawn, even though it will often be unnecessary to display the entire second group of balls to the players. At block 582 each gaming terminal 100 displays only the first X balls of the second group, where X is equal to the number of allotted daubs that each individual player has remaining. Also displayed to the player are the playing cards associated with each displayed ball from the second draw. Thus, it will be appreciated that the number of balls from the second drawing that will initially be displayed on each player's gaming terminal 100 may vary from terminal to terminal. For instance, referring to FIGS. 12 and 13, the player viewing the video display 105 corresponding to FIG. 12 is initially shown a plurality of ball icons 920, 921 and 922 while the player viewing the video display 105 corresponding to FIG. 13 is simultaneously shown only a ball icon 920. Each spot corresponding to the initially shown balls drawn in the second drawing is autodaubed for individual players as indicated at block 584.

At block 586 the pattern formed by the balls selectively daubed by the player from the first draw as well as the balls initially displayed from the second group that were autodaubed are evaluated to determine if the player has formed a winning bingo pattern. If the player has formed a winning bingo pattern, the player is paid for the win at block 588. At block 590 the network computer 310, in communication with the gaming terminals 100, determines which player completed a winning bingo pattern first. "First" as used herein preferably refers to the completion of a bingo pattern using the nth ball drawn, as is typical in electronic and non-electronic bingo games known today. However, in alternative embodiments, "first" may also mean completing a bingo pattern in the fewest daubs or fewest selective daubs (as opposed to autodaubs) or may mean temporally completing the pattern first by being the first player to complete a pattern and press the Continue Draw button 145. At block 592 the player who first completed a winning pattern is awarded an additional payout based on the pay table shown in FIG. 9. Alternatively, the player who first completed a winning pattern may only be awarded the greater of the two values determined at block 588 and block 592.

If no player enrolled in the current game completes a bingo pattern in the allotted five daubs, the gaming system 300 proceeds to block 594. At block 594 additional bingo balls are drawn and autodaubed on each player's bingo card 900 or 960 until the first winning pattern is formed and detected at logic block 596. The first "draw" of additional balls may involve revealing balls drawn in the second group draw that were initially not displayed on one or more player's game terminal 100 one at a time. If no bingo pattern is completed in this fashion, or if in an alternative embodiment the undisplayed balls from the second group draw are ignored, the network computer 310 may draw balls one at a time from the remaining forty-two balls until a bingo pattern is completed. Alternatively, if no player completes a game-ending pattern in the allotment of daubs, all of the balls and daubs from the first two draws may be ignored or effectively erased, and balls may be drawn and automatically daubed from a refreshed set of fifty-two bingo balls until a game-ending bingo pattern is formed on at least one player's terminal. Once a bingo pattern is completed and detected at block 598 the player completing the pattern is paid for a First Pay win as indicated on the pay table shown at FIG. 9 and the game is ended. In some embodiments it may be desirable to require the player who wins the First Pay to interact with gaming terminal 100 in some fashion, for instance by hitting a "Collect Win" button 145. Failure to do so in a given amount of time may result in the player "sleeping" his win away, in which case the gaming system 300 will ignore this first win and continue drawing balls until a second player receives a first win. This could, of course, apply to all wins, not just the First Pay wins.

Referring now to FIG. 12 and FIG. 13, the end results of the game can now be analyzed and the payouts received by each player can be explained. Focusing first on FIG. 12, the player chose at block 574 to daub spots 953 and 954. These spots are both in the eleventh column (the Queen column). Therefore this player had already completed the bingo pattern that pays one credit on the Standard Pay table and $1/100^{th}$ of a credit on the First Pay table (i.e., two spots in the same column, where the column is the $10^{th}$, $11^{th}$, $12^{th}$ or $13^{th}$ column). Assuming that no other player completed a bingo pattern by the fifth ball (i.e., the last ball of the first draw) the player would already be entitled to the First Pay. However, because the player only used two of his allotted daubs, he received three additional bingo balls in the second ball draw indicated at block 580. The first three balls drawn in the second ball draw were balls numbered twenty-six, twenty-two and thirty-six as indicated by ball icons 920, 921 and 922. The three playing cards associated with the spots matching these balls for the player playing the game represented at FIG. 12 are a Six of Clubs 923, a Six of Spades 924, and an Eight of Spades 925. Thus, when the player's bingo card 900 is evaluated at block 586, the player has completed a pattern of two spots in one column and two spots in another column and receives a pay of two credits, see FIG. 9. The collection of the five displayed playing cards forms a poker-hand ranking of two pair—Queens and Sixes.

Turning to FIG. 13, the second player chose at block 574 to daub a plurality of spots 961, 962, 963 and 964, thereby using four of his five allotted daubs. Therefore, the second player only receives the first ball of the second ball draw, as indicated by ball icon 920. A spot 966 matching ball number twenty-six completes the bingo pattern of one spot in each of five consecutive columns, for which the player is paid five credits. Referring to the player's bingo card 960, the playing card associated with the fifth daubed spot 966 is a Seven of Clubs 926. This playing card 926 thus completes a seven-high straight.

Those familiar with the art of video poker as well as statistics will understand that the foregoing embodiment nearly perfectly matches the mathematical principles at work in video poker. The only exception being that in the 4×13 matrix used in the example, the Ace must play either high or low. In the described and preferred embodiment the Ace plays high. This minor irregularity could of course be rectified by including a fourteenth column for a low Ace. Preferably the bingo ball numbers in this fourteenth column would exactly match the numbers in the column for the high Ace. Thus, the bingo pay table shown in FIG. 9 nearly perfectly approximates the pay table for the popular video poker game known as 9/6 Jacks or Better. The probability and expected value of each hand in the 9/6 Jacks or Better game is represented by the Table 1 below:

TABLE 1

| 9/6 Jacks or Better | | | |
|---|---|---|---|
| Hand | Probability | Payout | Expected Return |
| Royal Flush | 0.00%* | 800** | 0.0198 |
| Straight Flush | 0.01% | 50 | 0.0055 |
| 4 of a Kind | 0.24% | 25 | 0.0591 |
| Full House | 1.15% | 9 | 0.1036 |
| Flush | 1.10% | 6 | 0.0661 |
| Straight | 1.12% | 4 | 0.0449 |
| 3 of a Kind | 7.45% | 3 | 0.2233 |
| Two Pair | 12.93% | 2 | 0.2586 |
| Jacks or Better | 21.46% | 1 | 0.2146 |
| TOTAL | 45.46% | n/a | 0.9955 |

*The probability of a Royal Flush occurring is about one in 40,390 hands.

**In an alternative embodiment, one or more payouts may be based on a progressive jackpot that increments over time, as is known in the gaming art. When such a progressive is used, it is most preferably paid for the most difficult pattern to complete, in this case the pattern corresponding to a Royal Flush.

In order to keep the expected value or expected return of the Standard Pay and First Pay portion of the game below 1.00, it is therefore necessary to limit the expected return of the First Pay portion to less than 0.0045 if the Standard Pay patterns are going to emulate a 9/6 Jacks or Better video poker game. In the preferred embodiment represented by FIG. 9, the probability of a First Pay win is approximately 50% when there are only two players enrolled. Therefore, the expected return of the First Pay win is 0.005. Although this yields a total expected return for the game of 1.0005, it will be appreciated by those familiar with the video poker art that, because players typically make strategy mistakes, a game with an expected return of 1.0005 could be profitably deployed by a casino or other gaming establishment. As an alternative to awarding 1/100 of a credit for the First Pay, the expected return of the First Pay may be modified by requiring more players to enroll before the game is initiated. For instance, if two hundred players are required to enroll before the game begins, each First Pay could pay one credit, resulting in a probability of approximately 0.5% for an expected return of 0.005. As with the first embodiment explained with reference to FIGS. 4A-4C, the First Pays in this embodiment need not be all of the same value nor do the patterns associated with the First Pays need to be the same as the patterns associated with the Standard Pays. Also, where a player achieves a pattern that would entitle him to both a Standard Pay and a First Pay it may be desirable to only pay the higher of the two payouts. As this is typically the Standard Pay, this would further reduce the expected value of the First Pay as an overall percentage of the game. It is also possible to lower the expected return for the Standard Pays by, for example, reducing the amount paid for a bingo pattern having three spots in one column and two spots in another column (i.e., a full house) from nine to eight and reducing the pay for five spots in one row (i.e., a flush) from six to five. This would lower the expected return of the Standard Pays to approximately 97% or 0.97 and would emulate the video poker game known as 8/5 Jacks or Better. However, in the most preferred embodiment of the invention, the expected return of the Standard Pays is not lowered significantly (e.g., more than 2%) below the expected return of the Las Vegas style video poker machines that the strategy based portion of the bingo game is emulating which is typically greater than 80%, and preferably greater than 90%, and most preferably greater than 95%. Therefore the ratio of the expected return from the Standard Pays to that of the First Pays will preferably be greater than or equal to approximately 16:1 and also preferably greater than approximately 32:1 and most preferably greater than 100:1.

For the previous embodiment that only pays a Standard Pay to each player from a pay table that emulates an 8/5 Jacks or Better video poker game for all patterns formed in five allotted daubs and that pays one-fifth of a credit for the first First Pay pattern formed if no player gets a Standard Pay (where the First Pay pattern is formed from a refreshed group of fifty-two balls without respect to previous daubs/balls) the approximate expected values for Standard Pays and First Pays are given by Table 2 below:

TABLE 2

| Expected Value Ratios 8/5 Jacks or Better | | | | | |
|---|---|---|---|---|---|
| Players | 2 | 3 | 4 | 5 | 6 |
| Standard Pay EV | 0.97298 | 0.97298 | 0.97298 | 0.97298 | 0.97298 |
| First Pay EV | 0.0297 | 0.01082 | 0.00442 | 0.00192 | 0.00092 |
| Total EV | 1.0027 | 0.9838 | 0.9774 | 0.9749 | 0.9739 |
| Ratio | | | | | |
| Standard:First | 33:1 | 90:1 | 220:1 | 507:1 | 1058:1 |

As an alternative to limiting the expected value of the First Pays to a small fraction of the expected value of the Standard Pays, it may be desirable to split each player's wager established at blocks 564 and 566 into two wagers (e.g., a Standard Wager and a First Wager). By doing so, each player could be entitled to two payouts based on the two wagered amounts. The first payout would be the First Wager times the First Pays result and the second payout would be the Standard Wager times the Standard Pays result. Although the First Wager and Standard Wager could be independent of each other, preferably the amounts would be dependent. In one preferred embodiment, the Standard Wager and the First Wager must be equal. In another preferred embodiment, the Standard Wager can be, at the player's option, a multiple of the First Wager, up to a maximum pre-established multiple amount. In all cases however, the expected value associated with the pays that are intended to emulate Las Vegas style video poker machines (arbitrarily referred to as the Standard Pays herein) will not vary significantly from the Las Vegas style video poker payouts. And preferably the expected value of one payout (arbitrarily referred to herein as the First Pays) will not vary based on the strategy used by an individual player.

Figure 15:
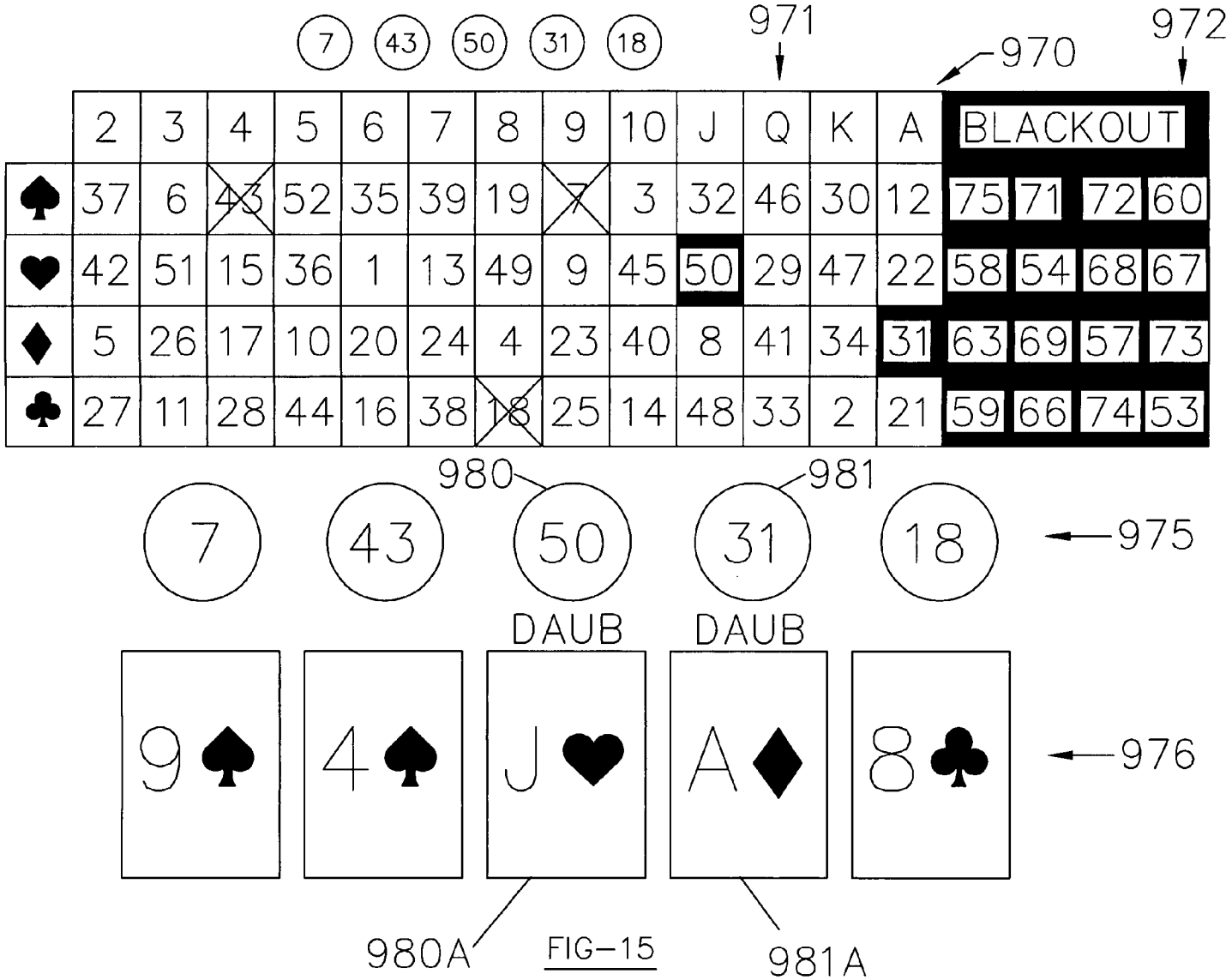
FIG. 15 shows a game of the present invention being played by a first player after the initial ball draw employing the pay table patterns defined in FIG. 14.
Figure 16:
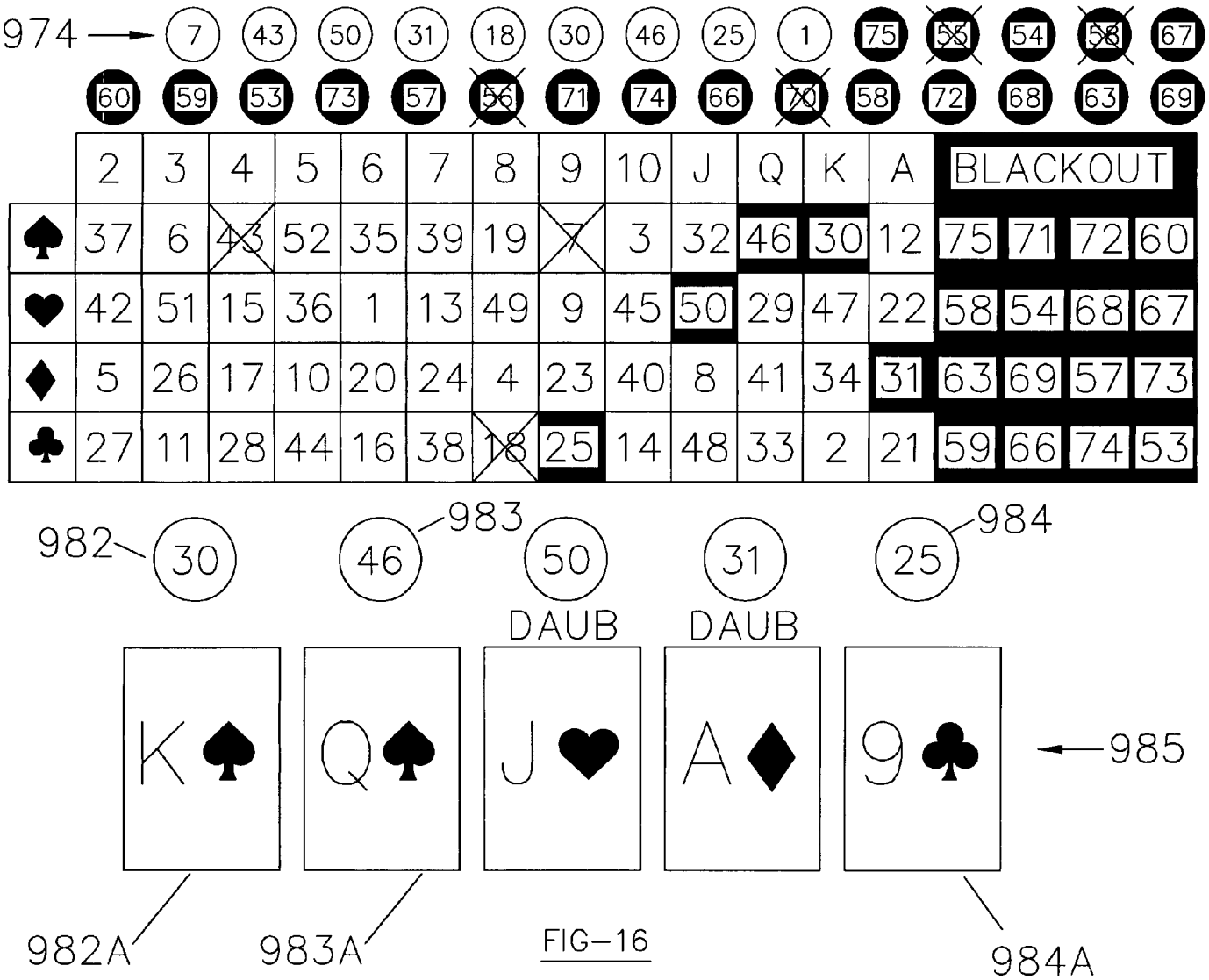
FIG. 16 shows the final result of the game initially depicted in FIG. 15.
Figure 20A:
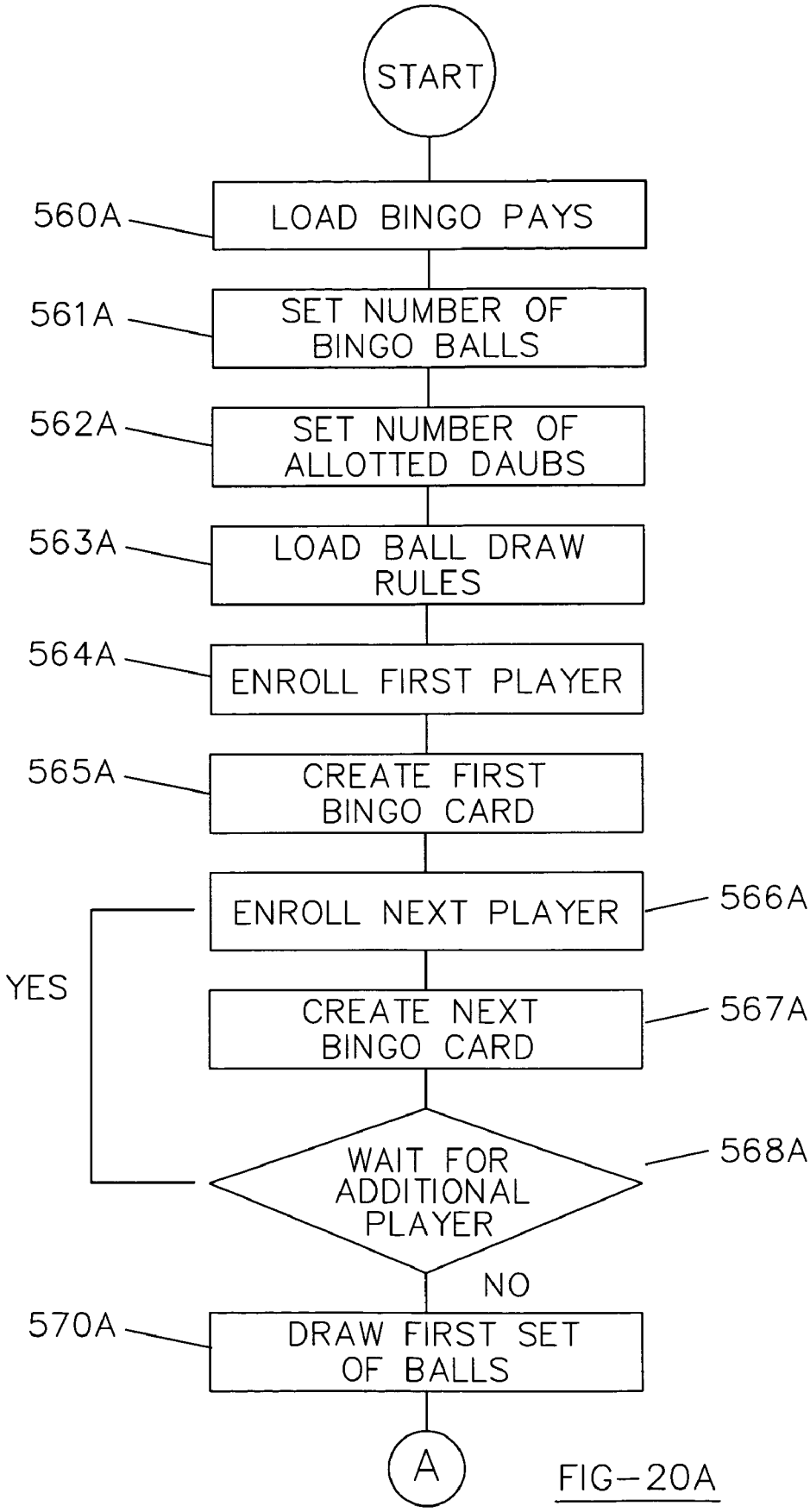
FIG. 20A-20C is a flow chart showing the steps according to an alternative embodiment of the present invention.
Figure 20B:
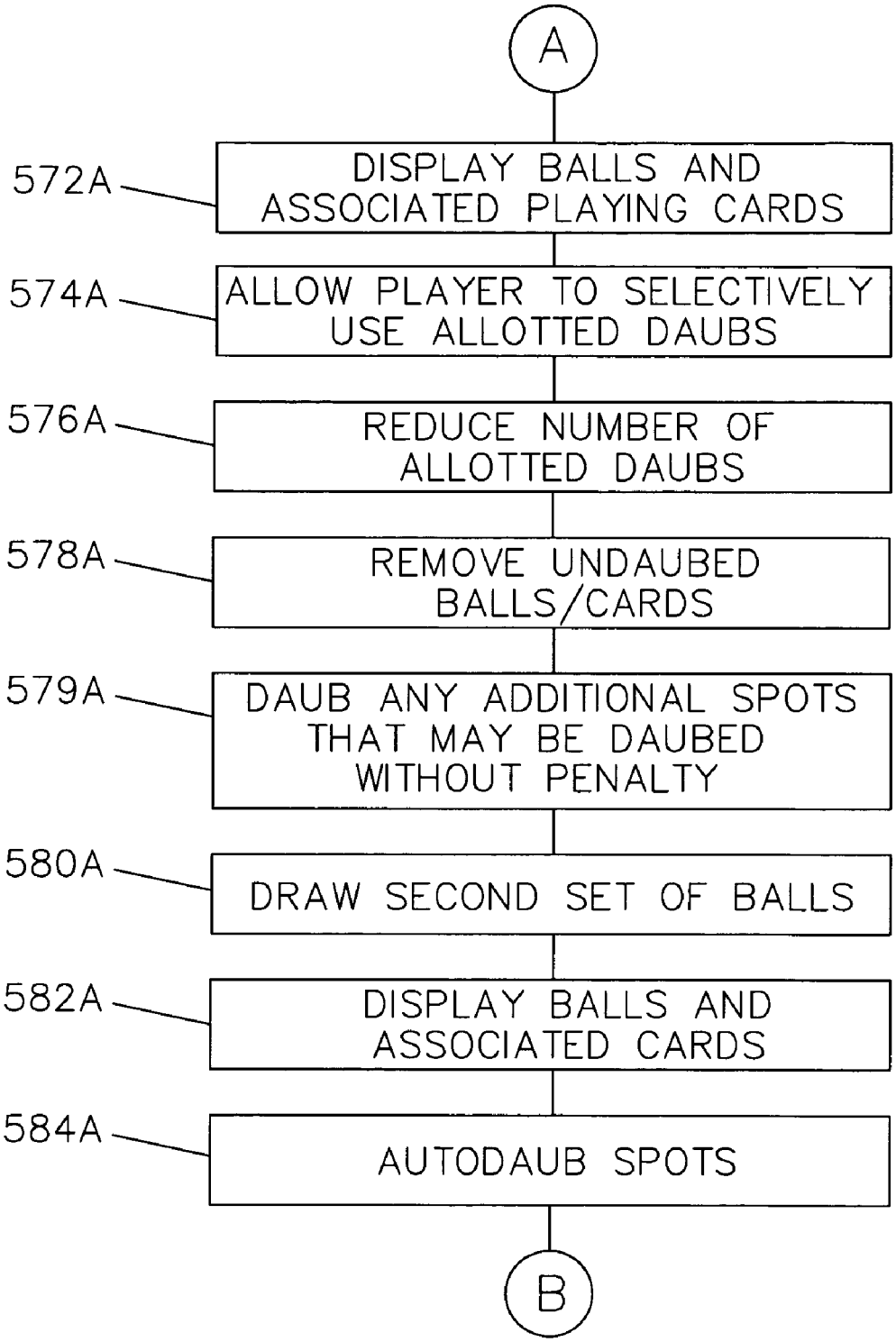
Figure 20C:
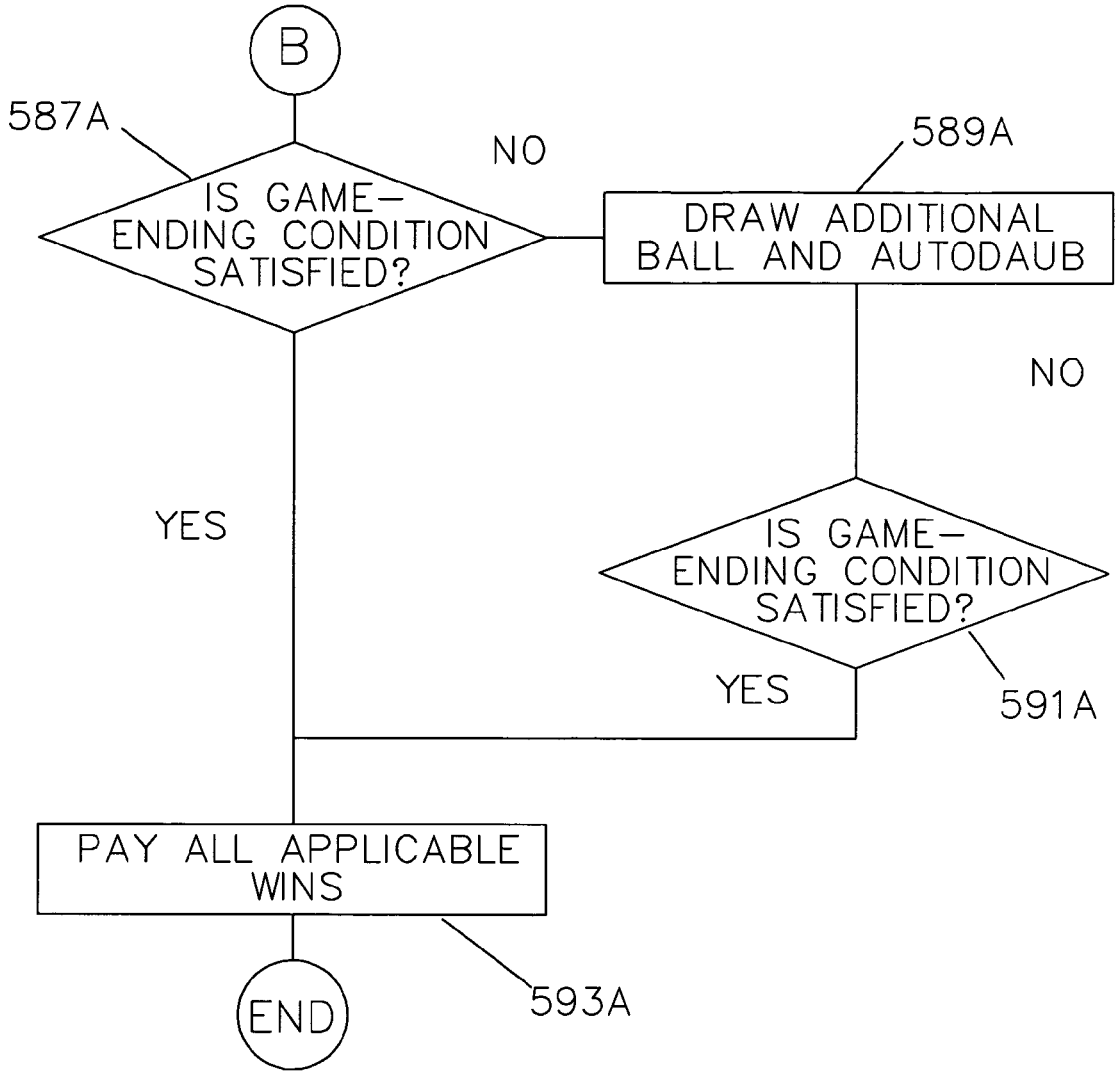

Referring now to FIGS. 14 to 16 and the flowchart in FIGS. 20A-20C, another alternative embodiment will now be discussed. At first, it will be noted that the flowchart in FIGS. 20A-20C is virtually identical to the flowchart in FIGS. 5A-5C, the primary difference being that certain parameters of the game have been left open in FIGS. 20A-20C. Beginning with block 560*a*, the bingo patterns indicated on FIG. 14 for a bingo card 970 are loaded by the gaming system 300. The Standard Pay bingo patterns defined on FIG. 14 emulate a popular Las Vegas style video poker game known as 6/5 Bonus Draw Poker. As is evident from FIG. 14 as well as FIGS. 15 and 16, the size of the bingo card 970 used in this embodiment is greater than 4×13. The bingo card 970 is comprised of two portions. A first portion 971 has a 4×13 matrix like the previous embodiments where one playing card from a deck of fifty-two playing cards is associated with each spot in the 4×13 portion 971, by associating card suits with each row and card ranks sequentially with the first thirteen columns. (To the extent it is desired to emulate a card game that uses a deck size other than fifty-two, the size of the 4×13 portion 971 may easily be adjusted accordingly. For instance, if it is desired to emulate a deck with three suits and values ranging from Eight to Ace, the first portion 971 would measure 3×7.) The bingo card 970 also includes a second portion 972 that measures 4×4. The spots of the second 4×4 portion 972 are not associated with playing cards. Proceeding to block 561*a*, the number of bingo balls set for the preferred embodiment of this variation is seventy-five bingo balls numbered one to seventy-five. However, any number of bingo balls, preferably greater than sixty-eight, may be used. At block 562*a*, the number of allotted daubs is set to five.

At block 563*a*, the gaming system 300 loads the ball draw rules. As with the embodiment described in FIGS. 5A-5C, this version will initially draw five bingo balls from the range of one to fifty-two, and will draw in the second set of bingo balls up to five more bingo balls from this range, as needed to utilize all of each player's remaining allotted daubs. However, the third set of bingo balls drawn—if needed—will be from the range of fifty-three to seventy-five.

At block 564*a* the gaming system 300 enrolls the first player and creates a bingo card 970 for the player. In the preferred embodiment, the creation of the bingo card 970 is random and carried out automatically by the gaming machine 100. However, the player may be allowed to create his own bingo card 970. In any event, the gaming system 300 is programmed such that each bingo card 970 created has the following criteria. The numbers between one and fifty-two are assigned to the spots in the 4×13 portion 971 of each player's bingo card 970, while sixteen numbers between fifty-three and seventy-five are associated with spots in the 4×4 portion 972.

As with previous embodiments, after all players' wagers and bingo cards 970 are established, the game begins with a first draw of five bingo balls 975 between the range of one and fifty-two at block 570*a*. Because the balls ranging from fifty-three to seventy-five were excluded from the first draw, no spots in the second 4×4 portion 972 may be daubed and exactly five spots in the first portion 971 of the bingo card 970 may be daubed. At block 572*a*, each gaming terminal will provide a visual display of the five bingo balls drawn 975, and a display of the five playing cards 976 associated with the drawn balls 975. Proceeding to block 574*a*, each player is allowed to use none to five of his allotted daubs on the balls drawn/matching spots. In the example represented by FIG. 15, the player has chosen to daub balls numbered fifty 980 and thirty-one 981. The corresponding spots on the bingo card 970 have been highlighted to indicate the daub. Similarly, the spots on the bingo card 970 corresponding to the remaining three balls that the player selected to forgo daubing have been covered by an X to indicate that they were not daubed. At block 576*a*, this player's number of allotted daubs would be reduced from five to three.

The result of this hypothetical player's choices can now be reviewed on FIG. 16. As indicated at block 578*a* and as can be seen on FIG. 16, the five balls from the first draw 975 and the five associated playing cards 976 have been removed from the display with the exception of ball number fifty 980 and an associated Jack of Hearts 980*a* and ball number thirty-one 981 and an associated Ace of Diamonds 981*a*. (Although the undaubed balls were removed from the main display, a player can still determine which balls were drawn by looking for the X's on the bingo card 970 or by examining a ball draw history 974 that shows all balls drawn and the order of the draw which may be maintained on a portion of either the central display 105 or the upper display 107.) Because there are no spots that can be daubed without penalty in this embodiment, a step at block 579*a* can essentially be skipped in this embodiment and the gaming system 300 proceeds to block 580*a* for the second ball draw. The next three balls that were drawn and automatically daubed as a result of blocks 580*a*, 582*a*, and 584*a* were a ball numbered thirty 982, a ball numbered forty-six 983 and a ball numbered twenty-five 984. The playing cards associated with these balls were a King of Spades 982*a*, a Queen of Spades 983*a* and a Nine of Clubs 984*a*, respectively. By looking at the ball draw history 974 it is apparent that the number one ball was drawn ninth at block 580*a*, but was not shown as a match on the player's bingo card 970. This may occur where another player had only daubed one ball during the first ball draw and thus needed four balls in the second draw to use his allotment of five daubs. These "extra" balls and any matching spots on the bingo card 970 may or may not be shown, but are preferably not relevant for evaluating any patterns created. In any event, the pattern formed by the player's five daubs did not match any of the winning Standard Pay patterns shown on FIG. 14, as further evidenced by the fact that an associated group of five displayed playing cards 985 shown in FIG. 16 did not form a winning poker hand, and therefore the player was not entitled to a Standard Pay win.

At block 587*a* the gaming system 300 determines if the game-ending condition has been satisfied, which in this particular example, as determined by the bingo patterns loaded at block 560*a*, is—at this stage of the game—the requirement that one or more players complete a Standard Pay pattern in five or fewer daubs. In the hypothetical represented, no player completed a Standard Pay pattern in five or fewer daubs, therefore the gaming system 300 proceeds to block 589*a* where a third ball draw is initiated. As indicated at blocks 589*a* and 591*a*, additional balls will be drawn and any matching spots of the players' bingo cards 970 will be daubed until at least one game-ending bingo pattern is formed. As determined by the ball draw rules loaded at block 563*a*, the balls drawn in the third draw will range from fifty-three to seventy-five. It would, of course, be possible to draw balls in the range of one to fifty-two. However, these balls are irrelevant at this stage of the particular embodiment because, as indicated on FIG. 14, the only game-ending pattern now in effect is a "blackout" or coverall of the 4×4 portion 972 of the bingo card 970. The 4×4 portion 972 only contains spots numbered fifty-three to seventy-five.

The result of the third ball draw for the hypothetical player can be seen on FIG. 16. Specifically, the ball draw history 974 shows the order of all balls drawn in the third ball draw. As shown, these balls are preferably displayed in a different color and preferably have some visual indication, such as an X on the ball, indicating if the drawn ball matches a spot on the 4×4 portion 972 of the bingo card 970. Additionally, spots in the 4×4 portion 972 matching the drawn balls are highlighted to indicate that the spot has been daubed. In the version shown, the only game-ending pattern associated with the 4×4 portion 972 is a blackout, as indicated on FIG. 14. However, other patterns may be used. As shown on FIG. 16, the hypothetical player has completed the blackout of his 4×4 portion 972 and therefore may be entitled to a payout at block 593*a*.

As with the first embodiment using a 4×13 matrix discussed, the expected value associated with the Standard Pays will preferably closely resemble the expected values of the payouts found on various Las Vegas style video poker machines. Therefore the ratio of the expected return from the Standard Pays/game-ending pays that are achieved in five or fewer selectively activated daubs to that of the First Pays achieved in the third ball draw will preferably be greater than or equal to approximately 16:1 and also preferably greater than approximately 32:1 and most preferably greater than 100:1. The approximate expected values for Standard Pays and First Pays for the particular embodiment shown in FIG. 14 and described above are given by Table 3 below:

TABLE 3

| Expected Value Ratios 6/5 Bonus Draw | | | | | |
|---|---|---|---|---|---|
| Players | 2 | 3 | 4 | 5 | 6 |
| Standard Pay EV | 0.9687 | 0.9687 | 0.9687 | 0.9687 | 0.9687 |
| First Pay EV | 0.0297 | 0.0108 | 0.0044 | 0.00 19 | 0.0009 |
| Total EV | 0.9984 | 0.9795 | 0.9731 | 0.9706 | 0.9696 |
| Ratio | | | | | |
| Standard:First | 33:1 | 90:1 | 222:1 | 518:1 | 1113:1 |

As demonstrated by Table 3, as well as the previous Table 2, the expected value associated with the First Pay wins decreases as the number of players increases, while the expected value associated with the Standard Pay wins remains constant. But as a result, the total expected value for the game decreases as the number of players increases. The reason for this is that when the First Pay wins remain constant, the likelihood of the game reaching the third ball draw, where the First Pay win is awarded, becomes less likely and the relative chances of a given player winning the First Pay win, even when the third ball draw is reached, is approximately inversely proportional to the number of players. To the extent the gaming operator desires to avoid this reduction in total expected value or to lessen it, the amount paid out for First Pay wins could easily be varied as a function of the number of players playing. For instance, rather than paying a fixed one-fifth of a credit for the First Pay, an alternative preferred embodiment could pay (N−1) fifths of a credit for a First Pay, where N is the number of players enrolled in the bingo game.

Referring now to FIGS. 17 to 19 and again to the logic flowchart in FIGS. 20A-20C, another embodiment will be discussed. Starting at block 560*a*, the first difference between the instant embodiment and the previous one is the size of the bingo card used. This embodiment uses a bingo card 990 that measures 5×13 and again has a first portion 991 measuring 4×13 where every spot in the first portion 991 is associated with a playing card. The bingo card 990 also has a second portion 992 measuring 1×13. Reviewing FIG. 17, it is apparent that the bingo patterns associated with the first portion 991 are again bingo patterns that emulate poker hands of known rankings. This time, the video poker game being emulated is a popular game known as 9/6 Double Bonus video poker. Also according to FIG. 17, spots covered in the second portion 992 of the bingo card 990 will serve two uses. First, as in the previous embodiment, the second portion 992 may be used to complete a game-ending pattern. Second, the number of spots covered in the second portion 992 during the first bingo ball draw will be used to determine a multiplier that will be applied to the Standard Pays due from patterns formed in the first portion 991 of the bingo card 990 as well as a possible payout due from any pattern formed in the second portion 992 of the bingo card 990. At block 561*a* the number of bingo balls is again set to seventy-five and at block 562*a* the number of allotted daubs that each player may selectively activate is again set at five.

The next difference between this embodiment and the previous one occurs at block 563*a* pertaining to the logic the gaming system 300 will use for ball draws. In this embodiment, the first ball draw will be from all seventy-five bingo balls and will continue until five balls ranging between numbers one and fifty-two have been drawn. Thus, the first draw of bingo balls will vary in length from game to game. However, it will be appreciated that because each bingo card 990 that is created at blocks 565*a* and 567*a* will have the numbers between one and fifty-two associated with the spots on the first 4×13 portion 991 of the bingo card 990, at the conclusion of the first draw, each player will have exactly five spots in the first portion 991 that are available for daubing. Of course, it would be possible to associate any range of numbers with the first portion 991 of the bingo card and to alter the ball draw rules such that the first draw would continue until five balls from that range have been drawn. And, provided that each bingo card 990 used the same numbers exclusively to complete the first portion 991, each player would have five spots available for daubing in the first portion 991 at the end of the first draw.

Figure 18:
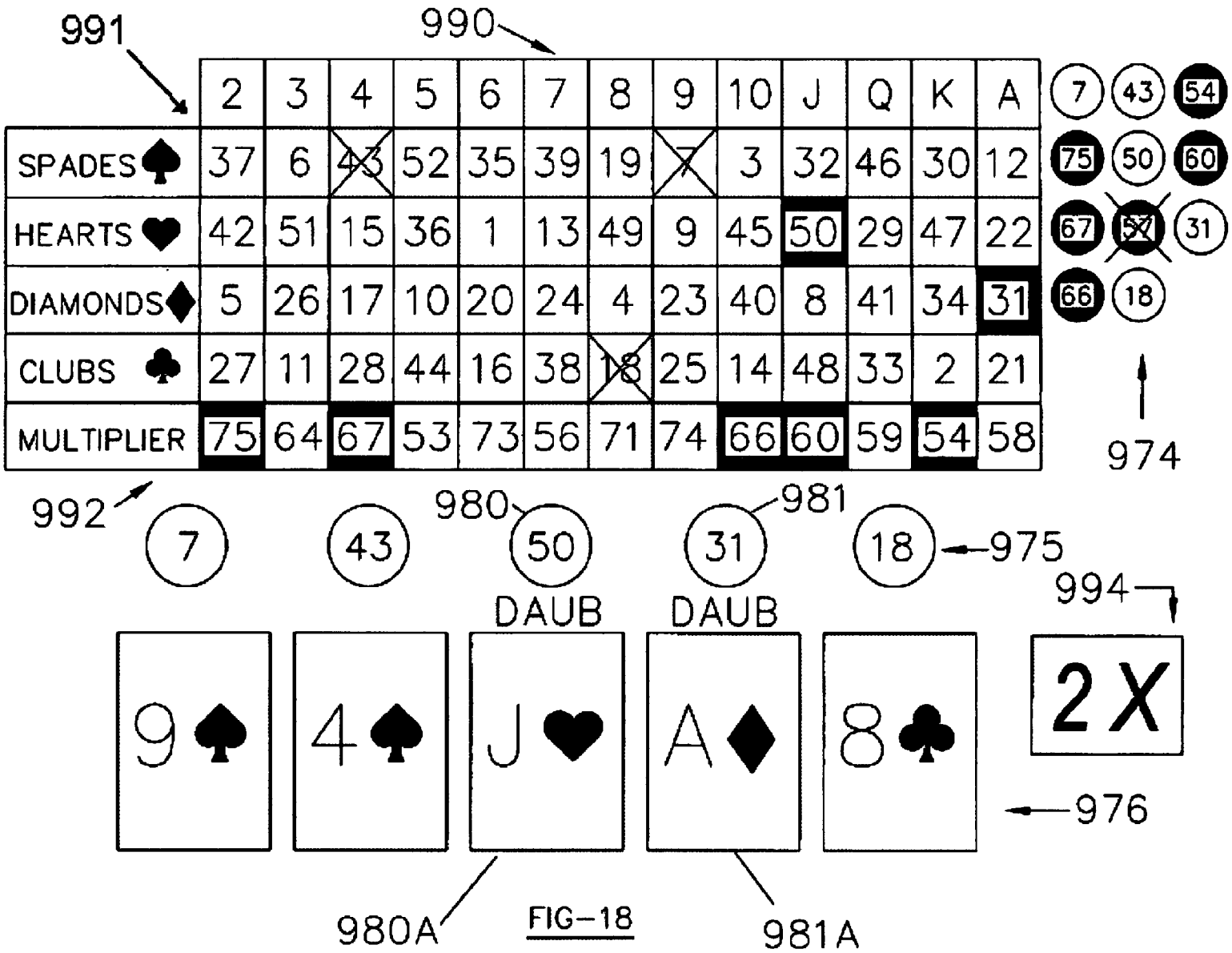
FIG. 18 shows a game of the present invention being played by a first player after the initial ball draw employing the pay table patterns defined in FIG. 17.
Figure 19:
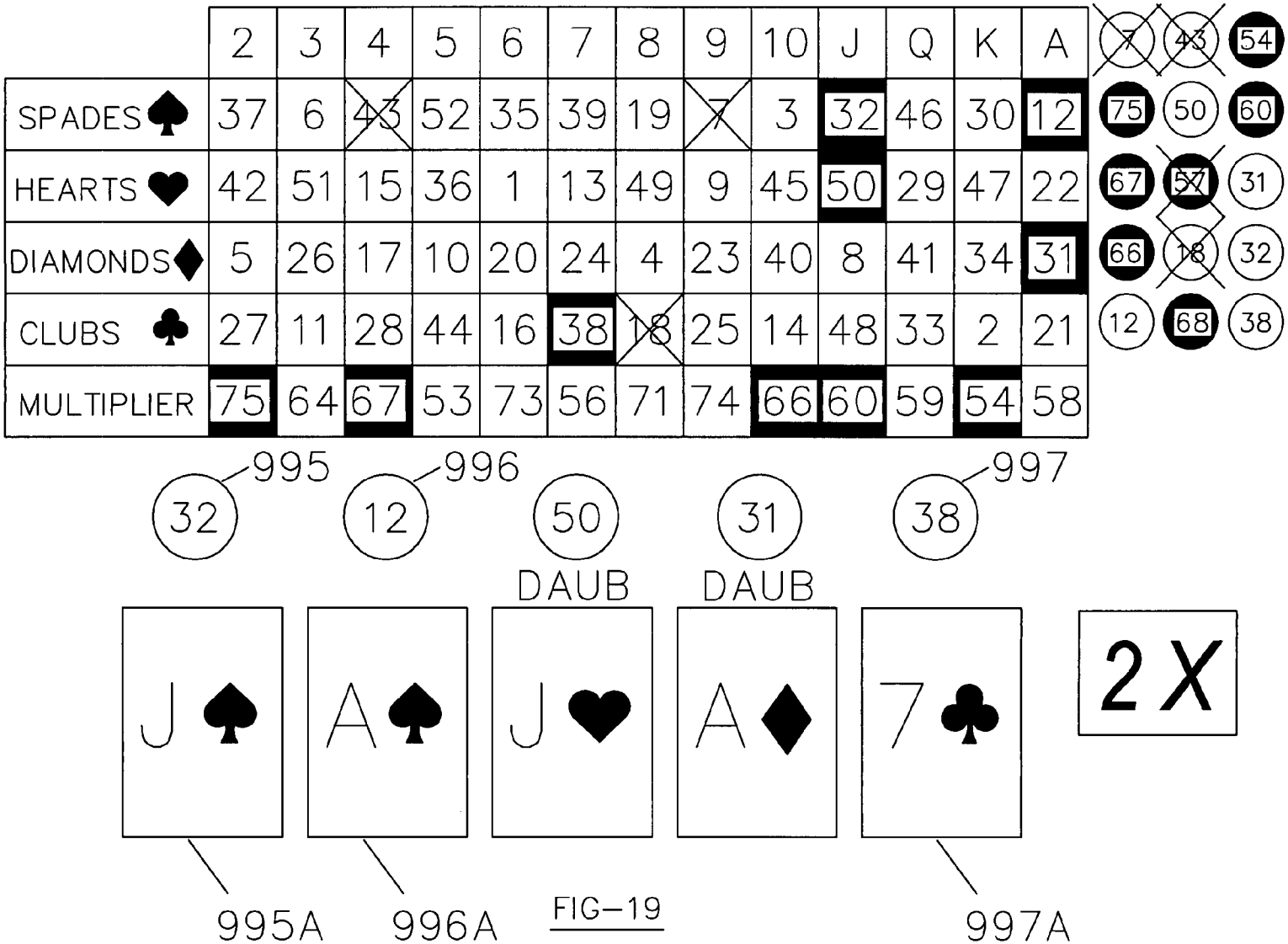
FIG. 19 shows the final result of the game initially depicted in FIG. 18.

Referring now to FIG. 18, the result of a first hypothetical ball draw will now be discussed. As is evident from the ball draw history 974, the first ball draw contained eleven balls, five of which were between the range of one and fifty-two. As before, a video representation of the five balls drawn between the range of one and fifty-two 975 is displayed along with a representation of each playing card 976 associated with the balls by virtue of the matching spots in the first portion 991 of the bingo card 990. The player is allowed to selectively daub balls matching the first portion 991 of the bingo card 990 as before and the gaming system 300 proceeds to block 579*a* on FIG. 20B.

Block 579*a* deals with the six balls that were drawn in the first draw that were between fifty-three and seventy-five. Five of the six balls matched spots in the second portion 992 of the bingo card 990. For convenience, these balls are displayed in the ball history 974 using a different color and the lack of a match between any ball and the player's second portion 992 has been indicated by placing an X over the ball(s). On FIG. 18, a group of five matching spots 993 on the second portion 992 of the bingo card 990 have been daubed at block 579*a*. These daubs are made without penalty and no further reduction of the player's allotment of daubs occurs as a result. Therefore, it is preferable that these spots 993 be daubed automatically. By allowing these daubs to be made without penalty, it should be appreciated that this embodiment will in some respects be similar to the first embodiment disclosed that used a 5×5 matrix and two types of daubs. In alternative embodiments, it would of course be possible to incorporate other teachings of this invention into the daubing process of any spots in the second portion 992 such that the daubing decision was a strategic decision.

Referring now to FIG. 17, it is apparent that the daubing of the five spots 993 in the second portion 992 of the bingo card 990 entitles the player to a "two times" multiplier of any resulting payout. Therefore, a multiplier indicator 994 may also be displayed to the player. It will be appreciated by those skilled in the art that any number of multiplication schemes may be used to give the game the desired payout and volatility. Although the instant embodiment only relies on the number of spots covered in the first draw, specific patterns or different ball draw schemes may also be used. For the disclosed method, the probability of any one player having N number of spots covered in the second portion 992 of his bingo card 990 at the conclusion of the first ball draw is given by the table below:

| N Spots | Probability |
|---|---|
| 0 | 0.3146 |
| 1 | 0.3409 |
| 2 | 0.2080 |
| 3 | 0.0920 |
| 4 | 0.0323 |
| 5 | 0.0093 |
| 6 | 0.0023 |
| 7 | 0.0005 |
| 8 | 0.0001 |
| 9 | 1.088E-05 |
| 10 | 1.195E-06 |
| 11 | 9.775E-08 |
| 12 | 5.320E-09 |
| 13 | 1.449E-10 |

Based on the multiplier pay table in FIG. 17 and the above probabilities, each player's Standard Pay will, on average, be multiplied by 1.0138. It will be appreciated that, given the extreme unlikelihood of a player covering thirteen, or even twelve or eleven spots in the second portion 992 of the bingo card 990 during the first ball draw, very large multipliers could be used without significantly altering the overall payback of the game. Thus, in some embodiments, it may be desirable to pay a progressive prize merely for covering thirteen spots during the first ball draw. In cases where completing a pattern on the second portion 992 may independently entitle the player to a prize (regardless of any Standard Pay that may be awarded due to a pattern on the first portion 991) it may be desirable to pause or stop the first ball draw just short of completing the pattern (e.g., once twelve spots have been hit) to allow the player the opportunity to appreciate the winning potential of the next ball(s) drawn.

Returning now to FIG. 19, the hypothetical results of the game can now be determined. As in the previous example, the player had chose to daub balls numbered fifty 980 and thirty-one 981. During the second ball draw, a ball numbered thirty-two 995, a ball numbered twelve 996 and a ball numbered thirty-eight 997, were drawn and automatically daubed. Balls numbered thirty-two 995 and twelve 996, in conjunction with previously daubed balls numbered fifty 980 and thirty-one 981 formed a Standard Pay pattern on the first portion 991 of the bingo card 990 of two spots in one column and two spots in another column. Referring to FIG. 17, this entitles the player to a Standard Pay of one credit, which will be further multiplied by two as a result of the spots on the second portion 992 of the bingo card 990 for a total payout of two. Because this Standard Pay pattern will also satisfy the game-ending condition, as disclosed to the player in the "Rules" portion of FIG. 17, the gaming system 300 will not initiate a third ball draw at block 587*a*, but instead will proceed directly to block 593*a* to make a payout to any player who completed a Standard Pay pattern.

As with the other embodiments disclosed, the expected value associated with the Standard Pays (preferably even as modified by the effects of the multiplier attributed to the second portion 992 of the bingo card 990) will preferably closely resemble the expected values of the payouts found on various Las Vegas style video poker machines. Therefore the ratio of the expected return from the Standard Pays/game-ending pays that are achieved in five or fewer selectively activated daubs to that of the game-ending pays achieved in the third ball draw (arbitrarily called First Pays for consistency) will preferably be greater than or equal to approximately 16:1 and also preferably greater than approximately 32:1 and most preferably greater than 100:1. The approximate expected values for Standard Pays and First Pays for the particular embodiment shown in FIG. 17 and described above are given by Table 4 below:

TABLE 4

| Expected Value Ratios 9/6 Double Bonus w/ Multiplier of 1.0138 | | | | | |
|---|---|---|---|---|---|
| Players | 2 | 3 | 4 | 5 | 6 |
| Standard Pay EV | 0.9770 | 0.9770 | 0.9770 | 0.9770 | 0.9770 |
| First Pay EV | 0.0309 | 0.0113 | 0.0047 | 0.0021 | 0.0010 |
| Total EV | 1.0079 | 0.9884 | 0.9818 | 0.9791 | 0.9780 |
| Ratio | | | | | |
| Standard:First | 32:1 | 86:1 | 207:1 | 470:1 | 1014:1 |

In addition to the second portion 992 being used to determine a multiplier, it will be appreciated that it could be used to trigger the simulation of a bonus game or other similar feature. The result of this feature could further be determined by patterns formed in the second portion 992, or any portion of the bingo card 990 or any other gaming-type mechanism.

As with the first 5×5 embodiment discussed, it is understood that a number of modifications to these embodiments could be made without altering the essence of the invention, such as mixing the various features of the disclosed embodiments in a variety of ways, or only paying a Standard Pay for the first bingo pattern formed among all the enrolled players or adjusting the number of balls in play or altering the various pay tables.

It should be appreciated that the step of associating spots on the player's bingo card or a portion of the bingo card with a particular playing card has at least two significant advantages for the present invention. First, it allows complicated pay table information for the underlying game of bingo to be expressed very succinctly. For instance, for the bingo pattern corresponding to a full house—three spots in one column and two spots in another column—there are 936 different bingo patterns in a 4×13 matrix that would meet this requirement. The need to visually depict each of these patterns in a See Pay's screen is negated by the gaming public's general familiarity with what a full house looks like when playing the game of video poker. The second, and somewhat related benefit, is that by associating a playing card with spots available for daubing, a great deal of information is being conveyed to the player about his chances of success in the game based on the instant ball in question without the player having to consult a rather complicated 4×13 matrix to determine what other balls may have also been drawn in the instant ball's corresponding row or column or in adjacent columns. By associating a single playing card with a spot on the bingo card's matrix, the player can tell by looking at each playing card, what row and column the corresponding spot is in the matrix. Additionally, by comparing the ranks and suits of the other displayed playing cards, the player can tell if additional spots may be daubed that are in the same row or column or an adjacent/near by row or column. Not only does this alleviate the need to review the accompanying drawn balls in the form of the matrix, but it also eliminates the need for the player to review the aforementioned complicated and large number of different visual bingo patterns that may be completed using any one given ball.

Playing a bingo game of the present invention, it is possible to incorporate nearly all of the features that are currently popular in Las Vegas style video poker games. For instance, one of the most popular video poker innovations of the last ten years is multi-handed video poker as described in U.S. Pat. No. 5,823,873 incorporated herein by reference. The most popular embodiment of the '873 patent is a video poker game commonly known as Triple Play Draw Poker®. In Triple Play Draw Poker®, a player is dealt one video poker hand and the cards that the player wishes to hold in the first hand are also used in a second and possibly third hand. This type of poker game could easily be emulated by the invention disclosed herein by allowing the player to purchase multiple bingo cards, but initially displaying just a single bingo card. After the player makes his initial daub decisions, the gaming terminal creates the additional bingo cards that were previously purchased. However, unlike the first bingo card that had all fifty-two spots randomly assigned a number, the additional cards will maintain the five spots that match to the first five bingo balls drawn and will mark any of these spots as daubed if they were daubed on the original card. The remaining forty-seven bingo numbers will then be randomly distributed in the matrix of the additional bingo cards and each card will be completed using a single second ball draw. Alternatively, a single bingo card could be used multiple times. In this variation, the player would again daub zero to five balls in the first ball draw. However, there would now be multiple second ball draws. The "first" second ball draw would chose from forty-seven numbers to emulate the completion of the first poker hand. The "second" second ball draw would chose from a different or refreshed set of forty-seven numbers to emulate the completion of the second poker hand, and so on. For the avoidance of confusion, different colored balls could be used for each draw or multiple identical bingo cards could be used.

It would also be a simple matter to incorporate "wild" spots into the matrix or multiplier spots into the matrix that double the pay table, thus approximating wild cards and multiplier jokers.

While this invention has been described with respect to several specific embodiments thereof, it should be understood that the invention is not limited to the disclosed embodiments, but rather that the invention is intended to cover various modifications and equivalent arrangements which will be apparent to those skilled in the art. It is thus to be understood that the invention should not be limited by the description, and that modifications and variations in the present invention may be made without departing from the novel aspects of this invention as defined in the claims.

What is claimed is:

1. A gaming system for playing a game of electronic bingo, the system comprising:

(a) a memory;

(b) a set of bingo balls stored in said memory, wherein at least some of said bingo balls bear an indicia;

(c) a central computer operatively connected to said memory, said central computer being programmed to draw bingo balls from the set of bingo balls;

(d) a plurality of gaming terminals, said gaming terminals operatively coupled to said central computer to communicate the bingo balls drawn from the set of bingo balls;

(e) a means for accepting a wager from a player at each gaming terminal;

(f) a bingo card displayed on each player's gaming terminal, each of said bingo cards comprising a matrix having at least a first portion and a second portion, wherein the matrix has a plurality of spots, at least some of said spots having a indicia corresponding to at least one of the bingo balls in the set of bingo balls;

(g) wherein the first portion of the matrix has a plurality of spots;

(h) wherein said second portion of the matrix has at least one spot, said second portion spots being distinct from the spots of the first portion of the matrix;

(i) said central computer programmed to randomly draw a first group of bingo balls from the set of bingo balls until the indicia associated with the first group of bingo balls match the indicia on at least five of the spots in the first portion of the bingo card on each gaming terminal;

(j) each of said gaming terminals programmed to display said first group of bingo balls, to indicate said matching at least five spots and to allow each player to selectively daub none, one, two, three, four or five of said matching spots in the first portion and to daub any matching spots in the second portion;

(k) said central computer programmed to randomly draw a second group of bingo balls from the set of bingo balls, until at least five spots in the first portion of each bingo card displayed on each gaming terminal are daubed;

(l) each of said gaming terminals programmed to respond to said second group of bingo balls drawn by displaying none, one or more of said balls in the second group of bingo balls and daubing none, one or more of any spots bearing indicia matching the indicia of said balls in the second group on at least the first portion of the bingo card displayed on said terminal;

(m) said memory storing a plurality of bingo patterns, wherein at least a plurality of said patterns are formed by spots in the first portion and have an associated payout amount and wherein at least one of said patterns are formed by spots in the second portion and have an associated payout modifier;

(n) said memory defining at least one of said bingo patterns as a game-ending pattern;

(o) each of said gaming terminals programmed to make a payout equal to the payout amount of the pattern, if any, formed in the first portion modified by the payout modifier of the pattern formed, if any, in the second portion;

(p) said central computer programmed to randomly draw a third group of bingo balls from the set of bingo balls if no player has completed a game-ending pattern as a result of the bingo balls drawn in the first and second groups.

2. The gaming system of claim 1 wherein each spot in the first portion is associated with at least one playing card and wherein one indicia from a subset of the indicia is associated with each spot in the first portion, the same subset of indicia being used for each first portion on the plurality of bingo cards displayed.

3. The gaming system of claim 2 wherein the first portion is comprised of at least four rows and at least thirteen columns and each spot in the first portion is associated with at least one playing card by associating each of said rows with a different playing card suit and by associating each of said columns with a different playing card rank.

4. The gaming system of claim 2 wherein the playing cards associated with the spots used to form at least some of the plurality of said bingo patterns formed by spots in the first portion create a poker hand of known ranking.

5. The gaming system of claim 4, wherein at least one of the game-ending patterns is formed by spots in the second portion.

* * * * *